US008016125B2

(12) United States Patent
Lockledge et al.

(10) Patent No.: US 8,016,125 B2
(45) Date of Patent: Sep. 13, 2011

(54) MATERIALS, FILTERS, AND SYSTEMS FOR IMMOBILIZING COMBUSTION BY-PRODUCTS AND CONTROLLING LUBRICANT VISCOSITY

(75) Inventors: Scott P. Lockledge, Lafayette Hill, PA (US); Darrell W. Brownawell, Black Butte Ranch, OR (US)

(73) Assignee: Lutek, LLC, Wilmington, DE (US)

( * ) Notice: Subject to any disclaimer, the term of this patent is extended or adjusted under 35 U.S.C. 154(b) by 1338 days.

(21) Appl. No.: 11/133,530

(22) Filed: May 20, 2005

(65) Prior Publication Data

US 2006/0261004 A1 Nov. 23, 2006

(51) Int. Cl.
*B01D 39/00* (2006.01)
*F01M 11/03* (2006.01)

(52) U.S. Cl. ..... 210/504; 210/502.1; 210/167.02; 210/206; 210/282

(58) Field of Classification Search ..... 210/232, 210/206, 209, 440, 444, 450, 504, 502.1, 210/167.02, 202, 259, 266, 282, 287, 416.1
See application file for complete search history.

(56) References Cited

U.S. PATENT DOCUMENTS

| | | | | |
|---|---|---|---|---|
| 2,316,080 | A | 4/1943 | Loane et al. | 252/48 |
| 2,617,049 | A | 11/1952 | Assef et al. | 260/503 |
| 2,647,889 | A | 8/1953 | Watson et al. | 260/139 |
| 2,835,688 | A | 5/1958 | Le Seur | 260/429.9 |
| 3,172,892 | A | 3/1965 | LeSeur et al. | 260/326.5 |
| 3,796,778 | A | 3/1974 | Gallacher | |
| 4,212,746 | A * | 7/1980 | Tholema et al. | 210/495 |
| 4,664,683 | A | 5/1987 | Degen et al. | 55/387 |
| 4,717,552 | A | 1/1988 | Carnell et al. | 423/230 |
| 4,828,698 | A | 5/1989 | Jewell et al. | 210/266 |
| 4,861,566 | A | 8/1989 | Denny | 423/230 |
| 4,865,826 | A | 9/1989 | Carnell et al. | 423/230 |
| 4,888,157 | A | 12/1989 | Carnell et al. | 423/230 |
| 4,894,210 | A | 1/1990 | Denny et al. | 423/230 |
| 4,906,389 | A | 3/1990 | Brownawell et al. | 252/25 |

(Continued)

FOREIGN PATENT DOCUMENTS

EP 0416907 A2 * 3/1991

(Continued)

OTHER PUBLICATIONS

Clague et al., A comparison of diesel engine soot with carbon black, 1999, Carbon, 37, pp. 1553-1565.*

(Continued)

*Primary Examiner* — Tony G Soohoo
*Assistant Examiner* — David C Mellon
(74) *Attorney, Agent, or Firm* — Woodcock Washburn LLP

(57) ABSTRACT

A chemical filter for use within an internal combustion engine lubrication system. The chemical filter employs filtration media including particles having internal pores and interstitial pores formed between adjacent particles. The internal pores and the interstitial pores collectively define filtration media pores, and a strong base material is associated with at least some of the internal pores. The filtration media has a surface area greater than or equal to 25 $m^2$/gm that is derived from filtration media pores that are large enough to receive a combustion acid-weak base complex contained within oil flowing through the chemical filter. This enables an ion-exchange process to occur that immobilizes the combustion acids and regenerates the weak base, so as to extend the time intervals between oil drains, among other benefits.

39 Claims, 14 Drawing Sheets

U.S. PATENT DOCUMENTS

| | | | | |
|---|---|---|---|---|
| 4,946,660 | A | 8/1990 | Denny et al. | 423/230 |
| 4,977,871 | A | 12/1990 | Brownawell et al. | 123/196 |
| 4,978,439 | A | 12/1990 | Carnell et al. | 208/91 |
| 4,983,365 | A | 1/1991 | Denny et al. | 423/230 |
| 4,997,546 | A | 3/1991 | Shaub et al. | 208/183 |
| 5,019,311 | A | 5/1991 | Koslow | 264/122 |
| 5,042,617 | A | 8/1991 | Brownawell | 184/6.24 |
| 5,069,799 | A | 12/1991 | Brownawell et al. | 210/749 |
| 5,112,482 | A | 5/1992 | Shaub et al. | 210/209 |
| 5,147,722 | A | 9/1992 | Koslow | 428/402 |
| 5,182,018 | A * | 1/1993 | Langston | 210/282 |
| 5,189,092 | A | 2/1993 | Koslow | 524/495 |
| 5,225,081 | A | 7/1993 | Brownawell | 210/690 |
| 5,249,948 | A | 10/1993 | Koslow | 425/376.1 |
| 5,331,037 | A | 7/1994 | Koslow | 524/496 |
| 5,346,619 | A * | 9/1994 | Funkenbusch et al. | 210/198.2 |
| 5,459,074 | A | 10/1995 | Muoni | 436/60 |
| 5,478,463 | A | 12/1995 | Brownawell et al. | 208/180 |
| 5,591,330 | A | 1/1997 | Lefebvre | 210/203 |
| 5,759,394 | A | 6/1998 | Rohrbach et al. | 210/264 |
| 5,792,513 | A | 8/1998 | Koslow et al. | 427/195 |
| 5,853,681 | A | 12/1998 | Denny et al. | 423/225 |
| 5,882,517 | A | 3/1999 | Chen et al. | 210/496 |
| 5,897,845 | A | 4/1999 | Denny et al. | 423/210 |
| 5,922,803 | A | 7/1999 | Koslow et al. | 524/496 |
| 5,928,588 | A | 7/1999 | Chen et al. | 264/113 |
| 6,007,706 | A | 12/1999 | Carnell et al. | 208/303 |
| 6,077,588 | A | 6/2000 | Koslow et al. | 428/114 |
| 6,103,116 | A | 8/2000 | Koslow et al. | 210/282 |
| 6,127,036 | A | 10/2000 | Xue et al. | 428/400 |
| 6,139,605 | A | 10/2000 | Carnell et al. | 95/164 |
| 6,221,241 | B1 | 4/2001 | Carnell et al. | 208/251 |
| 6,355,330 | B1 | 3/2002 | Koslow et al. | 428/114 |
| 6,379,564 | B1 | 4/2002 | Rohrbach et al. | 210/765 |
| 6,395,190 | B1 | 5/2002 | Koslow et al. | 210/767 |
| 6,482,326 | B2 * | 11/2002 | Munson et al. | 210/663 |
| 6,485,813 | B1 | 11/2002 | Koslow | 428/198 |
| 6,505,597 | B2 | 1/2003 | Zulauf et al. | 123/196 |
| 6,550,622 | B2 | 4/2003 | Koslow | 210/490 |
| 6,623,636 | B2 | 9/2003 | Rohrbach et al. | 210/202 |
| 6,630,016 | B2 | 10/2003 | Koslow | 95/285 |
| 6,703,071 | B2 | 3/2004 | Koslow | 427/195 |
| 6,719,869 | B2 | 4/2004 | Koslow | 156/276 |
| 6,770,204 | B1 | 8/2004 | Koslow | 210/663 |
| 7,410,572 | B2 | 8/2008 | Beard et al. | |
| 7,913,858 | B2 * | 3/2011 | Haberkamp et al. | 210/501 |
| 2002/0014447 | A1 | 2/2002 | Rohrbach et al. | 210/209 |
| 2002/0028166 | A1 | 3/2002 | Hendricks et al. | 423/210 |
| 2002/0195384 | A1 | 12/2002 | Rohrbach et al. | 210/266 |
| 2003/0089092 | A1 | 5/2003 | Bause et al. | 55/524 |
| 2003/0111398 | A1 | 6/2003 | Eilers et al. | 210/209 |
| 2004/0178142 | A1 | 9/2004 | Koslow | 210/500.29 |
| 2006/0032814 | A1 | 2/2006 | Haberkamp et al. | 210/502.1 |

FOREIGN PATENT DOCUMENTS

| | | | |
|---|---|---|---|
| WO | WO 01/05583 | A1 | 1/2001 |
| WO | WO 01/92005 | A1 | 12/2001 |
| WO | WO 02/32548 | A1 | 4/2002 |
| WO | WO 02/083265 | A3 | 10/2002 |

OTHER PUBLICATIONS

Mathis et al., Influence of diesel engine combustion parameters on primary soot particle diameter, Feb. 4, 2005, Environmental Science and Technology, 39, pp. 1887-1892.*

Mann, R. "Fluid Catalytic Cracking: Some Recent Developments in Catalyst Particle Design and Unit Hardware", *Catalysis Today,* 1993, 18, 509-528.

Mirrezaei-Roudaki, J., "Applications of Visualized Porosimetry for Pore Structure Characterisation of Adsorbents and Catalysts", The 1994 ICHEME Research Event, 565-567.

Paul A. Webb., "An Introduction to the Physical Characterization of Materials", Mercury Intrusion Porosimetry with Emphasis on Reduction and Presentation of Experimental Data, Jan. 2001, 1-22.

Webb, P.A. et al., "Analytical Methods in Fine Particle Technology", Micromeritics Instrument Corp:, Norcross, Georgia, 1997, 172-173.

Won, Y-Y. et al., "Effect of Temperature on Carbon-Black Agglomerates in Hydrocarbon Liquid with Adsorbed Dispersant", *Langmuir,* 2005, 21, 924-932.

* cited by examiner

| | |
|---|---|
| Manufacturer | Katalco<br>ICI |
| Commercial Name | Catalyst<br>75-1 |
| Material | ZnO |
| **Hg Intrusion Porosimetry Data** | |
| Total Intrusion Volume, ml/gm | 0.3 |
| Usable Pore Surface, $m^2$/gm (1066 to 60 Å) | 15-21 (Calculated values: *see* Background of the Invention section) |
| **Nitrogen Adsorption Data** | |
| BET Surface Area, $m^2$/gm | 80 (value disclosed in U.S. Patent No. 4,894,210) |

*FIG. 15*

| Manufacturer | Martin Marietta | Martin Marietta | U.S. Zinc | GH Chemicals |
|---|---|---|---|---|
| Commercial Name | Magchem P98, Dead Burned | Magchem 10, Hard Burned | AZO77HS A | CR-40 |
| Material | MgO | MgO | ZnO | ZnO |
| **Usable Surface Area** | | | | |
| BET Surface Area Reported By Manufacturer, $m^2$/gm | <0.1 | <10 | 9 | 5 |

*FIG. 16*

| Manufacturer | Iowa Limestone | Iowa Limestone | Franklin Industrial Minerals | Franklin Industrial Minerals | Great Lakes | Great Lakes |
|---|---|---|---|---|---|---|
| Commercial Name | Unical S | Unical F | C6 X 16 | C8 X 12 | 20 X 200 | 12 X 40 |
| Material | Limestone | Limestone | Limestone | Limestone | Limestone | Limestone |
| BET Surface Area Reported By Manufacturer, $m^2/gm$ | 0.42 | 0.038 | <0.5 | <0.5 | <0.5 | <0.5 |

*FIG. 17*

| Manufacturer | Martin Marietta | Martin Marietta | Martin Marietta | Martin Marietta | Premier Chemicals | Premier Chemicals | Premier Chemicals | Premier Chemicals | Bayer | Lanxess | Hydro Technologies |
|---|---|---|---|---|---|---|---|---|---|---|---|
| Commercial Name | Magchem 30 | Magchem 40 | Magchem 50 | Magchem HSA 30 | MagOx 98 LR | MagOx 98 HR | Premium | Super Premium | Zinkoxyd Akiv | ZnO Transparent | ZnO HT Active |
| Material | MgO | MgO | MgO | MgO | MgO | MgO | MgO | MgO | ZnO | $ZnCO^3$/ZnO/ MgO | ZnO |
| **Hg Intrusion Porosimetry Data** | | | | | | | | | | | |
| Total Intrusion Volume, ml/gm | 1.3 | 1.2 | 1.2 | 1.2 | 1.4 | 1.3 | 1.2 | 1.2 | 1.3 | 1.2 | 0.8 |
| Total Pore Area, $m^2$/gm | 33 | 59 | 75 | 160 | 49 | 79 | 105 | 130 | 44 | 53 | 61 |
| Median Pore Diameter, Å | 354 | 174 | 141 | 55 | 219 | 116 | 62 | 55 | 301 | 258 | 94 |
| Usable Pore Surface, $m^2$/gm (1066 to 80 Å) | 26 | 49 | 64 | 32 | 40 | 50 | 34 | 34 | 37 | 45 | 33 |
| Usable Pore Surface, $m^2$/gm (1066 to 60 Å) | 27 | 52 | 68 | 62 | 41 | 61 | 49 | 52 | 38 | 47 | 44 |
| **Nitrogen Adsorption Data** | | | | | | | | | | | |
| BET Surface Area, $m^2$/gm | 24 | 43 | 56 | 173 | 36 | 66 | 114 | 153 | 29 | 37 | 53 |
| BET Surface Area Reported By Manufacturer, $m^2$/gm | 20 to 30 | 45 | 65 | 160 | 40 | 65 | 110 | 150 | 45 | 45 | 40 |

*FIG. 18*

MATERIALS, FILTERS, AND SYSTEMS FOR IMMOBILIZING COMBUSTION BY-PRODUCTS AND CONTROLLING LUBRICANT VISCOSITY

FIELD OF THE INVENTION

The present invention relates to chemical filters employed within the lubrication system of internal combustion engines. Preferred embodiments of the chemical filters are useful for capturing combustion acids, among other combustion by-products, which can cause excessive engine wear due to their corrosive proclivity, and for regenerating dispersants used to control viscosity increase resulting from sludge and soot formation. Systems and methods utilizing the chemical filters are also disclosed. The present invention also provides novel filtration materials and porous structures useful for filtering lubricants cycled through internal combustion engines.

BACKGROUND OF THE INVENTION

During operation of an internal combustion engine, hydrocarbon fuel and oxygen burn in the presence of nitrogen. The fuel is converted principally into carbon dioxide and water, creating extremely high gas pressures that displace pistons to produce engine power. This combustion also results in the formation of contaminants. These contaminants include soot, which is formed from incomplete combustion, as well as organic, sulfur-based and nitrogen-based acids. Each contaminant causes engine wear, increased oil viscosity and unwanted deposits when introduced into lubricating oil through contact with the lubricant in the cylinder bore or in blow-by gases.

One method for controlling combustion by-products has been to include additives, such as detergents and dispersants, in the lubricating oils to interact with the contaminants. For example, additives can be employed to inhibit agglomeration of sludge and soot, and thereby minimize the formation of viscosity-increasing materials. Additives may also be employed to neutralize combustion acids to minimize corrosive wear.

There are, however, limitations to the use of additives for combustion by-product control. During normal operation of an engine, combustion acids deplete additives through the formation of salts that render their protective properties ineffective. Before additive exhaustion, it is necessary to drain and replace the lubricant.

Further, additives have upper concentration limits in commercial lubricant formulations. Beyond a certain concentration, detergents themselves can add to piston deposits. At high concentrations, dispersants can increase viscosity especially at low temperatures because they have a higher molecular weight than oil. The additive concentration upper limit in commercial lubricants thus determines the intervals between oil drains.

Frequent oil drains have both direct and indirect consumer costs, as well as environmental impact. For each oil drain, consumers bear the direct costs of a new filter and lubricant, mechanic labor, and in the case of commercial trucks, lost delivery time. Consumers bear the indirect costs of filter and lubricant recycle or disposal. They also endure the negative environmental impact associated with the inappropriate disposal of engine oil. Extended oil drain intervals accordingly conserve valuable resources.

In order to reduce emissions, engine manufacturers have begun employing a technology known as Exhaust Gas Recirculation ("EGR"). This technology recycles exhaust back into the combustion chamber. Acids and soot particles that would otherwise be emitted to the atmosphere instead enter the lubrication system through the boundary layer of lubricant in the piston chamber and via blow-by gases. Thus, while EGR may improve emissions, it produces an increased load of soot and acid in the oil, and eventually may lead to a decrease in oil drain intervals due to the limitations on additive concentrations that may be employed in lubricating oils.

Another method for controlling combustion by-products has been to include a chemical filtration medium in oil filters that is capable of capturing the by-products and/or replenishing lubricating oil additives as oil cycles through the filters. For example, Brownawell, et al. in U.S. Pat. No. 4,906,389, U.S. Pat. No. 5,068,044, U.S. Pat. No. 5,069,799, U.S. Pat. No. 5,164,101 and U.S. Pat. No. 5,478,463, teach disposing strong base materials in an oil filter to immobilize combustion acids transported to the oil filter in the form of a combustion acid-weak base complex. Soluble weak bases, commonly referred to as dispersants, are typically employed in commercial lubricants to help neutralize combustion acids and control viscosity increase. The weak bases and combustion acids interact to form soluble neutral salts that travel within the lubricating oil from the piston ring zone of an internal combustion engine to the oil filter. A strong base material immobilized in the oil filter displaces the weak base from the complex, thereby immobilizing the combustion acids in the oil filter and recycling the weak base to neutralize subsequently produced combustion acids. In effect, there is an ion exchange whereby the strong base disposed in the oil filter exchanges with the weak base in the combustion acid-weak base complex. As a result, the weak base is regenerated and recycled with the lubricant to neutralize additional acid. The immobilization of the combustion acids and the reuse of detergent and dispersant allows an increase in the time between oil drains.

The Brownawell, et al. examples teach the use of strong bases such as calcium carbonate, magnesium carbonate, magnesium oxide and zinc oxide, among others. While the teachings of Brownawell, et al. provided a positive contribution to the arts, the disclosures fail to indicate any understanding of the strong base's morphology and its impact upon exchange kinetics and capacity. Applicants of the present invention, including common inventor Darrell W. Brownawell, have since discovered that not all strong base materials are created equal with respect to their ability to immobilize combustion acids and control viscosity increase.

For example, it has been discovered that the exchange between the weak base-combustion acid complex and the strong base is to a large degree an irreversible surface phenomenon under engine operating conditions. Thus, the more surface area available for this exchange, the higher the capacity of the strong base to immobilize combustion acids. A non-porous material comprising a strong base accordingly will have only its external surface area available for acid immobilization. In comparison, a highly porous material may have an increased amount of surface area, since it has internal as well as external surface area. Additionally, applicants of the present invention have determined that a portion of the surface area may not be available for the exchange due to the physical dimension of the weak base.

If the combustion acid-weak base complex is too large to enter a pore, then a strong base associated with that pore effectively is unavailable to displace the weak base and to capture the combustion acid. Pores must be large enough to accept the complex. Pores may also be too large, whereby the particle structural integrity is compromised. For example, the pores may collapse during the manufacturing and/or handling of the material, or when exposed to fluid pressure as oil is circulated through a filter containing the material.

The inventors of the above-listed patents identify only one specific strong base material—Catalyst 75-1 from ICI/Katalco. As discussed below, this material provides a limited amount of usable surface area for accepting combustion acid-weak base complexes.

The zinc oxide adsorbent Catalyst 75-1 scavenges hydrogen sulfide ($H_2S$) from sour gas production and its high capacity derives from a high surface area engineered to capture this small molecule. While it does function in the lubrication application described in the patents above, its suitability is far from ideal. Hydrogen sulfide has a small cross-sectional diameter (<5 Å) and pores that allow its free diffusion may be much too small to adsorb the combustion acid-weak base complexes (believed to have a mean cross-sectional diameter of approximately 60 Å) occurring in a lubrication system.

1-5), mercury porosimetry overestimates its surface area. Electron micrographs of samples with low melting point alloy intrusion (see "Application of Three-Dimensional Stochastic Pore Network to Zinc Oxide Particle" S. Javad-Mirrezaei Roudaki, Dissertation for the degree of Master of Science, Dept. of Chemical Engineering, University of Manchester Institute of Science and Technology, February 1989; "Applications of Visualized Porosimetry for Pore Structure Characterization of Adsorbents and Catalysts" The 1994 ICHEME Research Event, J. Mirrezaei-Roudaki, A. AlLamy, R. Mann, A. Holt, 1994) clearly show the presence of voids in this material that range from one to seven microns. These voids are not present in the mercury intrusion data, but may account for a minimum of 50% of the total intrusion volume. In addition, macroscopic cracks and voids account for up to another 15% of the total intrusion volume. These large voids contribute less than one $m^2$/gm of usable surface area to the total surface area. A summary of the Applicant's calculations, based on the above discussion, is shown in Table 1 below.

TABLE 1

Usable Surface Area of Catalyst 75-1 determined by Mercury Intrusion Porosimetry and Low Melting Point Alloy Intrusion

| Comment | $V_{total}$, ($cm^3$/gm) | $D_{pore}$, (Angstroms) | Constant | $A_{total}$, ($m^2$/gm)[a] |
|---|---|---|---|---|
| Incorrectly ignoring "shielding" and "ink bottle" effects[b] | 0.30[c] | 300[d] | 4 | 40 |
| Subtracting volume due to 1-7 micron voids (50% of pore volume comprises large voids)[e] | 0.15 | 300 | 4 | 20 |
| Subtracting volume due to 1-7 micron voids and cracks (65% of pore volume comprises large voids)[e] | 0.105 | 300 | 4 | 14 |
| Remaining pores with diameters greater than ca. 1 micron contribute negligible usable surface area | 0.15-0.195 | 10,000 | 4 | 0.6-0.78 |
| Surface area accessible to weak base-combustion acid complex within catalyst 75-1 | | | | 15-21 |

Table Notes:

[a]Calculations of total surface area using Washburn's Equation model, A = 4V/D

[b]"Analytical Methods in Fine Particle Technology," Webb, P.A., Orr, C., Micromeritics Instrument Corp., Norcross, GA, 1997, pp 172-73

[c]Pore Volume = 0.30 $cm^3$/gm, typical of Catalyst 75-1 (see U.S. Pat. No. 4,717,552)

[d]Average Pore Diameter = 300 Å, typical of catalyst 75-1 (see "Application of Three-Dimensional Stochastic Pore Network to Zinc Oxide Particle" S. Javad - Mirrezaei Roudaki, Dissertation for the degree of Master of Science, Dept. of Chemical Engineering, University of Manchester Institute of Science and Technology, February 1989)

[e]Volume of micron sized pores, see electron micrographs of Low Melting Point Alloy Intrusion in Catalyst 75-1 (see "Application of Three-Dimensional Stochastic Pore Network to Zinc Oxide Particle" S. Javad - Mirrezaei Roudaki, Dissertation for the degree of Master of Science, Dept. of Chemical Engineering, University of Manchester Institute of Science and Technology, February 1989; "Applications of Visualized Porosimetry for Pore Structure Characterization of Adsorbents and Catalysts" The 1994 ICHEME Research Event, J. Mirrezaei-Roudaki, A. AlLamy, R. Mann, A. Holt, 1994

Although Catalyst 75-1 is no longer manufactured, its usable surface area may be calculated from information occurring in the open literature. Using published values for pore volume (see, e.g., U.S. Pat. No. 4,717,552) and pore diameter measured using mercury intrusion porosimetry ("Application of Three-Dimensional Stochastic Pore Network to Zinc Oxide Particle" S. Javad-Mirrezaei Roudaki, Dissertation for the degree of Master of Science, Dept. of Chemical Engineering, University of Manchester Institute of Science and Technology, February 1989), the total usable surface area of Catalyst 75-1 for this application may be initially calculated to be approximately 40 m 2/gm. However, catalyst 75-1 is a spherical formed particle and due to well-documented shielding, ink bottle, and skin effects (see, e.g., "Analytical Methods in Fine Particle Technology" Webb, P. A., Orr, C;. Micromeritics Instrument Corp.; Norcross, Ga.; 1997, pp 172-173; Catalysis Today, 18 (1993) 509-528; and The Canadian Journal of Chemical Engineering, 83 (2005)

Thus, the usable surface area of Catalyst 75-1 for this application conservatively falls within the range of 15-21 $m^2$/gm, when macroscopic void volume is properly taken into account. A surface area larger than 21 $m^2$/gm derived from pores sufficiently sized to accept combustion acid-weak base complexes would enable the exchange capacity to be maximized and oil drain intervals to be lengthened.

In light of the foregoing, what is still needed is a chemical filter comprising a strong base material having increased usable surface area that is capable of efficiently immobilizing combustion acids and controlling viscosity increase.

SUMMARY OF THE INVENTION

Applicants have recognized that not all strong base materials are created equal when attempting to effectively and efficiently immobilize combustion acids. Applicants have recognized the importance of strong base morphology and the appropriate balancing of corresponding parameters such as pore volume, pore size and total usable surface area.

Chemical filters are provided that employ chemically active filtration media useful for capturing combustion acids and potentially other combustion by-products that can cause excessive engine wear. The chemical filters also recycle dispersants capable of neutralizing subsequently produced combustion-related acids and controlling viscosity increase. The chemical filters are not limited in configuration, or placement within a lubrication system. By way of example only, the chemical filters may be substituted for or added to known full flow or by-pass oil filters. The chemical filters may also be independent from these known filters.

In accordance with filter embodiments of the present invention, the chemically active filtration media includes highly porous particles having internal pores, at least some of which are capable of receiving combustion acid-weak base complexes. A strong base material is associated with many of the internal pores to accomplish an ion exchange whereby the strong base exchanges with the weak base in the combustion acid-weak base complex. As a result of this ion exchange, the combustion acids are immobilized with the chemical filter and the weak base is regenerated and recycled with the lubricant to neutralize additional acid. The time interval between oil drains accordingly increases, so that economic and environmental benefits can be realized.

The filtration media preferably has a surface area greater than or equal to 25 $m^2$/gm that is derived from filtration media pores (combination of internal pores and interstitial pores) that are large enough to receive a combustion acid-weak base complex contained within oil flowing through the chemical filter. These filtration media pores preferably have a pore diameter greater than or equal to about 60 Angstroms as measured by mercury intrusion porosimetry. In one embodiment, a greater percentage of the filtration media surface area is derived from filtration media pores having a pore diameter that is larger than or equal to about 80 Angstroms than filtration media pores having a pore diameter that is smaller than about 80 Angstroms. The pore volume associated with the filtration media pores is preferably greater than 0.3 ml/gm.

Interstitial pores are defined as pores between adjacent particles. The interstitial pores in one embodiment of the invention are uniformly distributed so as not to cause excessive flow through one portion of the filtration media or channeling. Preferably, at least some of the interstitial pores are large enough to allow debris, which is capable of arising in a lubrication system, to pass through the filtration media without blockage or excessive pressure buildup. A majority of the interstitial pores preferably have a diameter that is less than about 500 micrometers.

Chemically active filter inserts are also provided by the present invention. The inserts are preferably designed and configured for disposition within an unused oil filter by the oil filter manufacturer. The inserts can also be designed and configured as an after market product that can be inserted into an oil filter already connected to a vehicle. One insert embodiment includes a chemically active filtration member having filtration media that is defined by highly porous particles. The pores preferably have a median pore diameter that is at least about 55 Angstroms. A strong base material is associated with as least some of the pores for effecting an ion exchange with a combustion acid-weak base complex. The filtration media preferably has a surface area greater than or equal to 25 $m^2$/gm in pores that are accessible to the weak base-acid complex.

Composite filtration media including at least two different types of active filtration media and binder material is provided. The active filtration media can be physically active or chemically active. In preferred embodiments, the composite filtration media includes both a physically active media and a chemically active media. In other embodiments, the composite filtration media may contain two or more different types of chemically active media.

Methods of making bound filtration media is another aspect of the present invention. Various end products can be made with the methods, including, but not limited to agglomerated particles and solid, porous filtration members. The methods employ a binder material and the application of heat to a temperature above at least the softening temperature (in some instances above the melting temperature) of the binder material but below the softening temperature of the filtration particles being bound.

Systems for controlling combustion by-products are also included. In accordance with one embodiment, the system includes a means for introducing gas exhaust into a combustion chamber that would otherwise by emitted to the atmosphere, an engine lubrication system containing a lubricating oil employing a weak base dispersant flowing therethrough, and a chemically active oil filter. One chemically active oil filter includes filtration media comprising particles having internal pores defined therein and interstitial pores formed between adjacent particles. Filtration media pores (collectively the internal pores and the interstitial pores) have a median pore diameter of from about 55 Angstroms to about 350 Angstroms. A strong base material is associated with at least some of the internal pores.

Porous structures useful for filtering lubricant cycling through an internal combustion engine lubrication system is one other aspect of the present invention.

These and various other features of novelty, and their respective advantages, are pointed out with particularity in the claims annexed hereto and forming a part hereof. However, for a better understanding of aspects of the invention, reference should be made to the drawings which form a further part hereof, and to the accompanying descriptive matter, in which there is illustrated preferred embodiments.

BRIEF DESCRIPTION OF THE DRAWINGS

FIG. 15 is a table of porosity characteristics associated with prior art strong base material Catalyst 75-1.

FIG. 16 is a table of porosity characteristics of candidate strong base materials.

FIG. 17 is a second table of porosity characteristics of candidate strong base materials.

FIG. 18 is a third table of porosity characteristics of candidate strong base materials.

DETAILED DESCRIPTION OF ILLUSTRATIVE EMBODIMENTS

Figure 1:
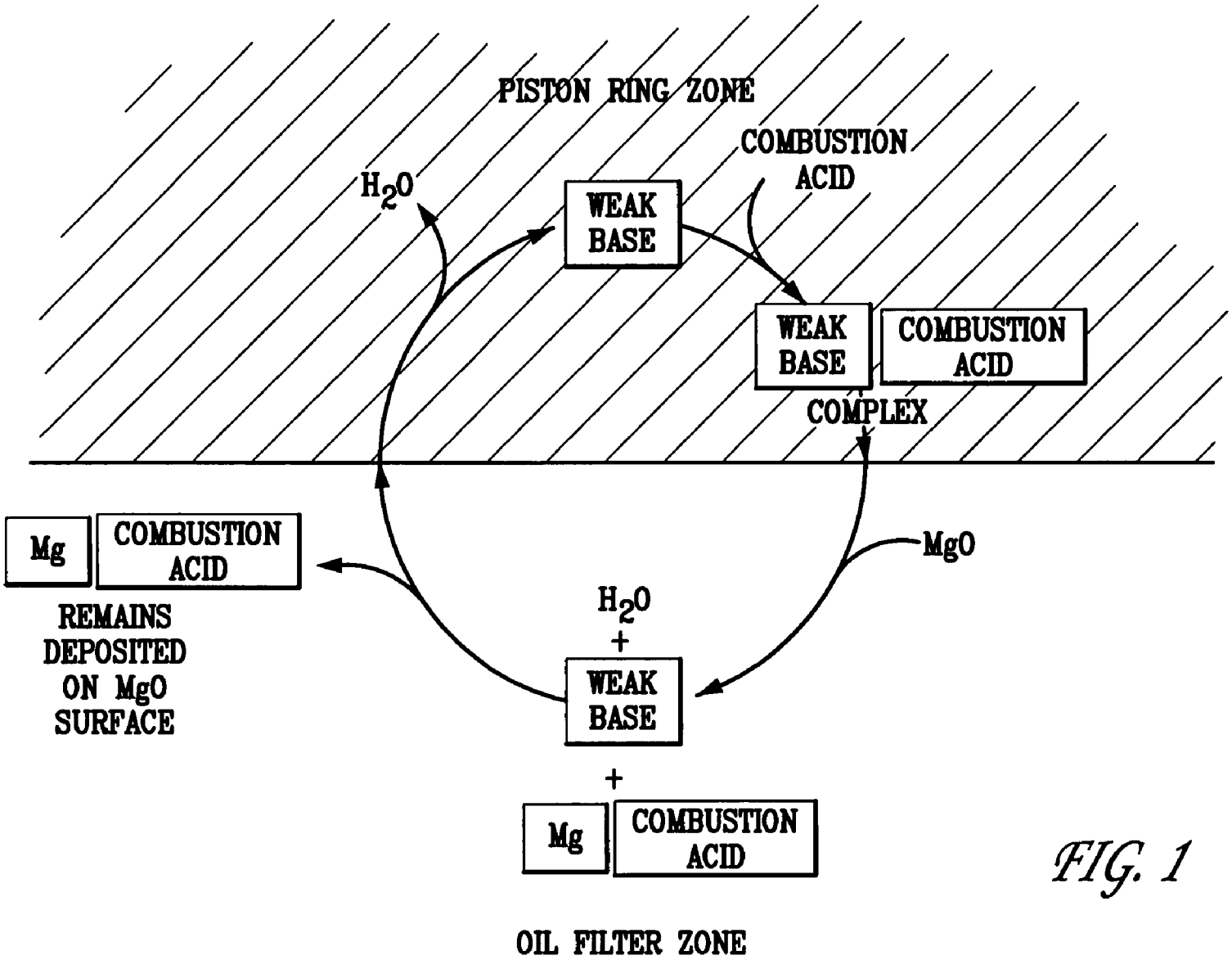
FIG. 1 is a schematic of one manner of how chemical filters of the present invention can function within the lubrication system of an internal combustion engine.

The present invention may be understood more readily by reference to the following detailed description of illustrative and preferred embodiments taken in connection with the accompanying figures that form a part of this disclosure. It is to be understood that the scope of the claims is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

As used herein, the term "inactive" filter or filter member means filtration occurs by size exclusion.

As used herein the term "physically active" means that filtration occurs via adsorption and/or absorption.

As used herein the term "chemical filter" or "chemically active filter" means a filter employing a strong base material that is capable of displacing a weak base from a combustion acid-weak base complex that comes into contact with the strong base material. Chemical filters and chemically active filters in accordance with the present invention may contain physically active filtration media in addition to the strong base material. They may also contain one or more inactive filters or filter members. The chemical filters of the present invention may also contain mixed filtration media made up of two or more different types of media, which can be physically active, chemically active, or both physically and chemically active.

Porosity characteristics are discussed throughout the specification. The skilled artisan would readily appreciate that there are a number of methodologies that can be used for assessing porosity characteristics, including gas adsorption and mercury intrusion porosimetry. Gas adsorption is generally-capable of measuring virtually all the surface area as defined by a material's internal pores, detecting pores having a diameter of from about 3.5 Angstroms to about 3,000 Angstroms. Among pores in that range, mercury intrusion porosimetry measures a subset of those pores, measuring down to a diameter of about 30 Angstroms. The preferred methodology for measuring porosity characteristics for this application is mercury intrusion porosimetry since gas adsorption accounts for pores that are believed to be too small for accepting a combustion acid-weak base complex. Exemplary mercury intrusion porosimetry equipment and methods are disclosed in "Analytical Methods in Fine Particle Technology," Paul A. Webb and Clyde Orr, Micromeritics Instrument Corporation, Norcross, Ga., Chapter 4, pp 155-191, 1997, and "An Introduction to the Physical Characterization of Materials by Mercury Intrusion Porosimetry with Emphasis on Reduction and Presentation of Experimental Data," Paul A. Webb, pp 1-22, Micromeritics Instrument Corporation, Norcross, Ga., January 2001.

Preferred filter embodiments in accordance with the present invention can be employed within the lubrication system of internal combustion engines to immobilize combustion acids and to control lubricant viscosity. Soluble weak bases ("dispersants") are typically employed in commercial lubricants to help neutralize combustion acids and to prevent agglomeration of soot particles. The combustion acids and soot particles enter the lubricant with combustion blow-by gases and through the boundary layer of lubricant that may or may not contain recycled exhaust gas. Neutralization preferably occurs before the acids reach metal surfaces to produce corrosion or piston deposits and before the soot particles form a three dimensional, viscosity-increasing structure. The weak bases and combustion acids interact to form acid-weak base complexes (or salts) that travel within the lubricating oil. The present invention provides chemical filters that employ filtration media comprising a strong base material. The chemical filters can be placed at any location within the lubrication system, such as, for example, the location of a traditional oil filter. The strong base material in the chemical filter displaces the weak base from the combustion acid-weak base complex. Once the weak base has been displaced from the soluble neutral salts, the combustion acid-strong base salts thus formed will be to a large degree immobilized as heterogeneous deposits with the strong base or with the strong base on a substrate if one is used. Thus, deposits which would normally be formed in the piston ring zone now occur outside this zone when the soluble salts contact the strong base. The combustion acids accordingly are sequestered in the chemical filter and the displaced weak base material is effectively recycled to neutralize subsequently produced acids. This displacement functions via ion exchange whereby the strong base disposed in the chemical filter exchanges with the weak base in the combustion acid-weak base complex. As a result, the weak base is regenerated and recycled with the lubricant to neutralize additional acid. FIG. 1 is a schematic of the above process.

The deployed chemical filter lengthens the time between oil drains by providing an additional mechanism to sequester combustion acids and disperse soot. In addition, the chemical filter can decrease piston deposits and reduce corrosion by transferring combustion acids from combustion acid-weak base complexes in the oil and immobilizing them with the strong base. The recycling of dispersant weak base materials for reuse in neutralization of the acidic surface of soot can minimize the increase of viscosity due to soot agglomeration.

Any fully formulated lubricant containing detergents and dispersants will work well with the chemical filters described by this invention. The lubricating (or crankcase) oil circulating within the lubrication system of a typical internal combustion engine will comprise a major amount of a lubricating oil basestock (or base oil) and a minor amount of one or more additives. The lubricating oil basestock can be derived from natural lubricating oils, synthetic lubricating oils, or mixtures thereof.

The lubricating oil will contain a weak base, which will normally be added to the lubricating oil during its formulation or manufacture. Broadly speaking, the weak bases can be basic organophosphorus compounds, basic organonitrogen compounds, or mixtures thereof, with basic organonitrogen compounds being preferred. Families of basic organophosphorus and organonitrogen compounds include aromatic compounds, aliphatic compounds, cycloaliphatic compounds, or mixtures thereof Examples of basic organonitrogen compounds include, but are not limited to, pyridines; anilines; piperazines; morpholines; alkyl, dialkyl, and trialky amines; alkyl polyamines; and alkyl and aryl guanidines. Alkyl, dialkyl, and trialkyl phosphines are examples of basic organophosphorus compounds.

Examples of particularly effective weak bases are the dialkyl amines ($R_2HN$), trialkyl amines ($R_3N$), dialkyl phosphines ($R_2HP$), and trialkyl phosphines ($R_3P$), where R is an alkyl group, H is hydrogen, N is nitrogen, and P is phosphorus. All of the alkyl groups in the amine or phosphine need not have the same chain length. The alkyl group should be substantially saturated and from 1 to 22 carbons in length. For the di- and tri-alkyl phosphines and the di- and trialkyl amines, the total number of carbon atoms in the alkyl groups should be from 12 to 66. Preferably, the individual alkyl group will be from 6 to 18, more preferably from 10 to 18, carbon atoms in length.

Trialkyl amines and trialkyl phosphines are preferred over the dialkyl amines and dialkyl phosphines. Examples of suitable dialkyl and trialkyl amines (or phosphines) include tributyl amine (or phosphine), dihexyl amine (or phosphine), decylethyl amine (or phosphine), trihexyl amine (or phosphine), trioctyl amine (or phosphine), trioctyldecyl amine (or phosphine), tridecyl amine (or phosphine), dioctyl amine (or phosphine), trieicosyl amine (or phosphine), tridocosyl amine (or phosphine), or mixtures thereof. Preferred trialkyl amines are trihexyl amine, trioctadecyl amine, or mixtures thereof, with trioctadecyl amine being particularly preferred. Preferred trialkyl phosphines are trihexyl phosphine, trioctyldecyl phosphine, or mixtures thereof, with trioctadecyl phosphine being particularly preferred. Still another example of a suitable weak base is the polyethyleneamine imide of polybutenylsuccinic anhydride with more than 60 carbons in the polybutenyl group.

The weak base must be strong enough to neutralize the combustion acids (i.e., form a salt). Suitable weak bases preferably have a PKa from about 4 to about 12. However, even strong organic bases (such as organoguanidines) can be utilized as the weak base if the strong base is an appropriate oxide or hydroxide and is capable of releasing the weak base from the weak base-combustion acid complex.

The molecular weight of the weak base should be such that the protonated nitrogen compound retains its oil solubility. Thus, the weak base should have sufficient solubility so that the salt formed does not separate from the oil. Adding alkyl groups to the weak base is the preferred method to ensure its solubility.

The amount of weak base in the lubricating oil for contact at the piston ring zone will vary depending upon the amount of combustion acids present, the degree of neutralization desired, and the specific applications of the oil. In general, the amount need only be that which is effective or sufficient to neutralize practically all acid as it enters the lubricant. Typically, the amount will range from about 0.01 to about 3 wt. % or more, preferably from about 0.1 to about 1.0 wt. %. At high concentrations, weak base dispersants can increase viscosity. The use of EGR has increased the acid load on the lubricant and increased the dispersant in the lubricant to the maximum commensurate with viscosity requirement.

It should be understood that the present invention is not limited to the types of lubricants or weak base materials disclosed above, and that any existing formulated lubricants or newly developed lubricants will likely be suitable for cooperation with the chemical filters of the present invention.

Figure 2:
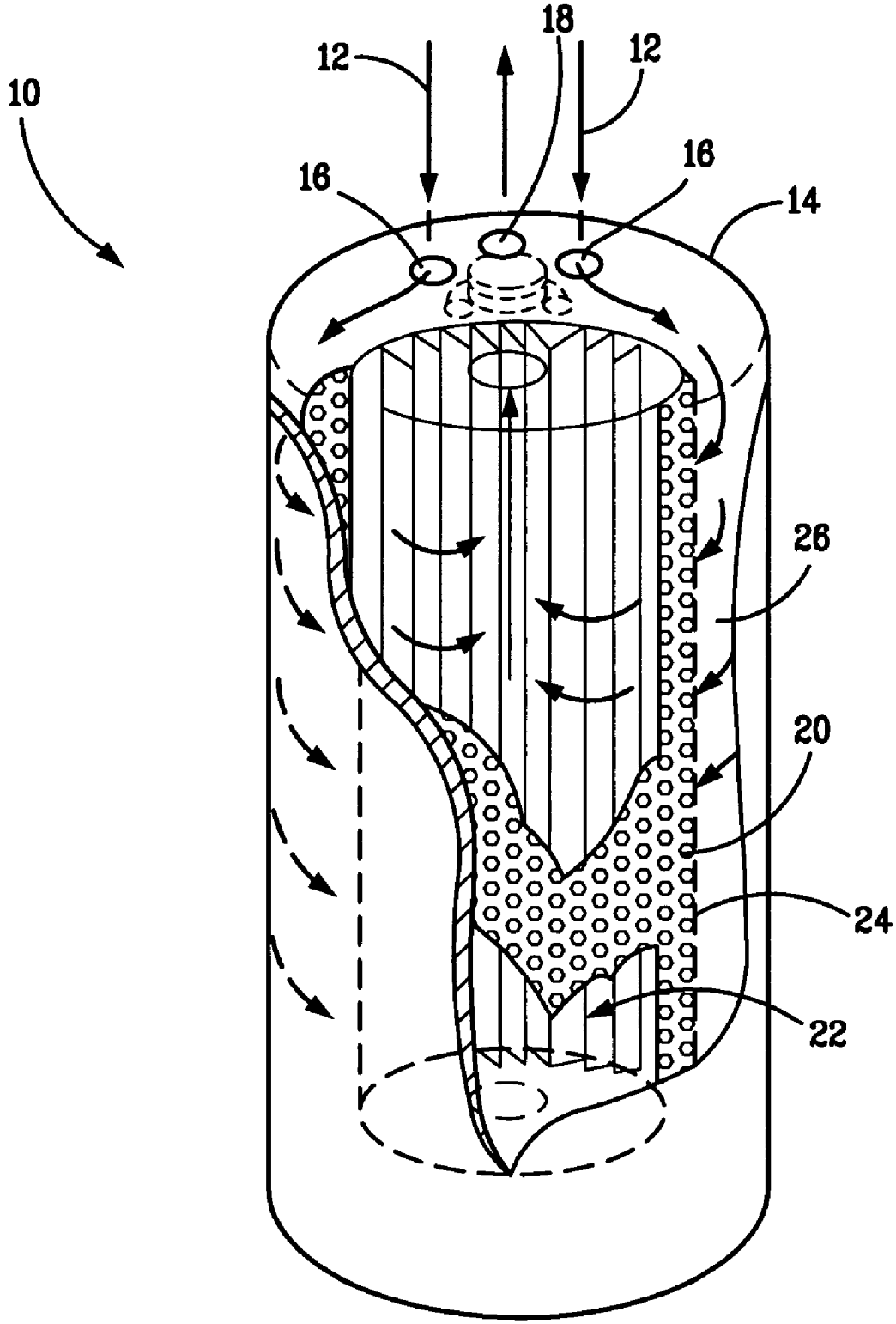
FIG. 2 is a perspective view of one full flow chemical filter embodiment in accordance with the present invention.
Figure 3:
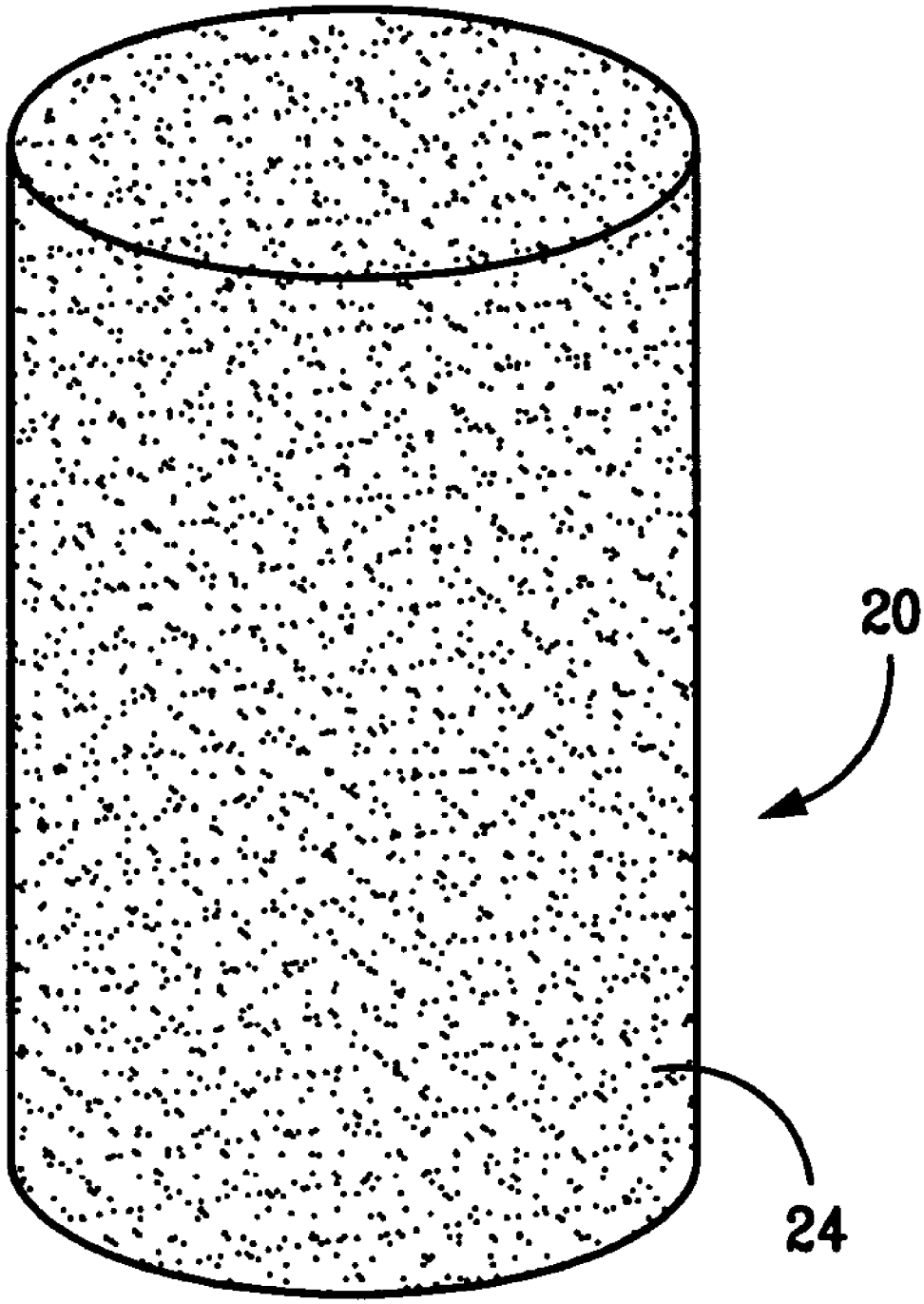
FIG. 3 is a perspective view of a chemically active filter insert provided by the present invention.

As shown in FIG. 2, an exemplary chemical filter 10 is created in the form of a modified conventional oil filter. Lubricating oil 12 is passed into a filter housing 14 having one or more oil inlets 16 and an oil outlet 18. Within filter housing 14 is a chemically active filter member 20 surrounding an inactive size-exclusion filter member 22. Chemically active filter member 20 includes filtration media 24 that contains a strong base material that will be described in more detail below. As shown more clearly in FIG. 3, chemically active filter member 20 is in the form of a cylindrical filter insert that can be sized and configured for disposition in a non-limited variety of positions, including that shown in FIG. 2 (i.e., radially outward from inactive size-exclusion filter member 22). A chemically active filter member or insert 20 can be formed into solid, porous structures with employment of binders and known processes for binding particulate matter, as discussed in more detail below.

As also shown in FIG. 2, oil containing combustion acid-weak base complexes enter filter housing 14 through inlets 16 and travels down annular space 26. The oil then flows radially inwardly and passes, in series, through chemically active filter member 20 and inactive size-exclusion filter member 22. When passing through chemically active filter member 20, the strong base material associated with filtration media 24 displaces the weak base from the complexes, thereby immobilizing the combustion acids in chemical filter 10. The oil containing recycled weak base material then exits filter 10 through outlet 18, and the recycled weak base material is made available to neutralize additional combustion-related acids. The features of chemical filter 10, and configuration of the same, is exemplary only and is not limiting for purposes of properly construing the appended claims. Furthermore, chemically active filter member 20 and filtration media 24 are drawn simply to illustrate that chemically active filter member 20 includes a collection of particulate matter that permits the through flow of oil. The figure is not intended to represent actual dimensionality of filtration media provided by the present invention. The size and distribution of the particulate matter, and the size and distribution of interstitial pores defined between adjacent particles, will be described in more detail below.

Figure 4:
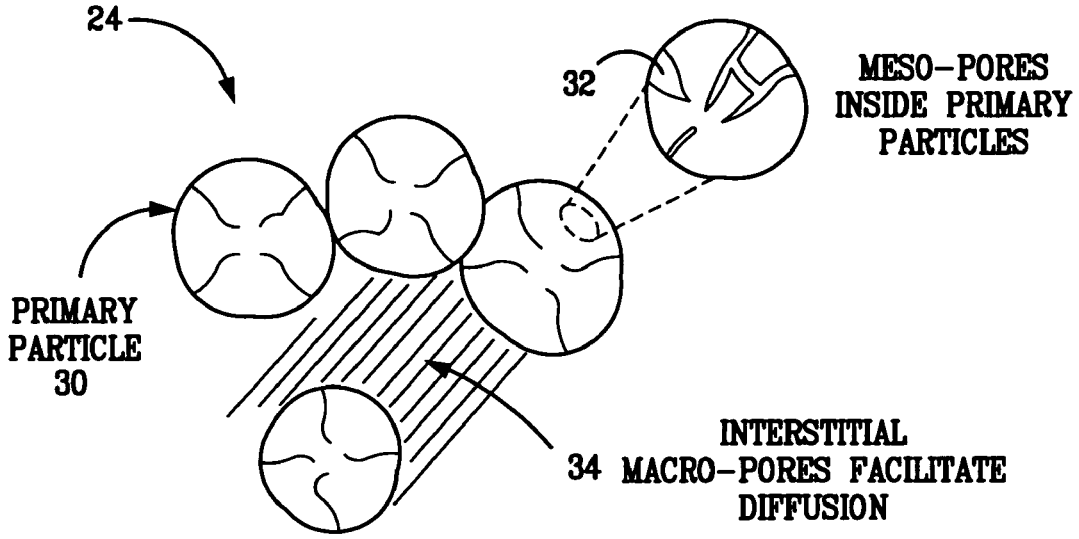
FIG. 4 is a schematic of filtration media particles suitable for use in preferred chemical filters of the present invention.

Filtration media 24 includes a collection of particles that are held closely together. FIG. 4 is a schematic of exemplary filtration media 24 that includes primary particles 30, which include internal pores 32, and interstitial pores 34 defined between adjacent particles 30 and that facilitate diffusion.

The pore diameter of a majority of interstitial pores 34 is preferably less than about 1 millimeter, and more preferably less than about 500 micrometers. In preferred embodiments, interstitial pores 34 are substantially uniformly distributed so as not to cause excessive channeling or flow through only a few portions of the filtration media. The interstitial pores are preferably large enough to allow debris, which is capable of arising in a lubrication system, to pass through the filtration media 24 without blockage or excessive pressure buildup. The size and distribution of the interstitial pores 34 can vary to a certain degree from the noted preferred characterizations while still being useful in accordance with the present invention. As used herein the term "filtration media pores" includes both internal pores and interstitial pores.

The particles are preferably bound together with a binder material. The particles can alternatively be held closely together with physical constraints (with or without employment of a binder), such as, for example, entrapped within or disposed on a surface of a fibrous web, or disposed on a sheet of filter paper or between multiple sheets of filter paper or the like. The fibrous webs can be made from natural fibers (including e.g. cellulosic fibers), synthetic fibers (e.g, polyethylene fibers) or a mixture of natural and synthetic fibers. Fibrous webs can employ typical fibers and/or "engineered fibers," such as those disclosed in U.S. Pat. Nos. 6,127,036 and 5,759,394. These wicking fibers trap dirt inside microscopic channels engineered into the physical filter fibers. Fibrous webs, filter paper sheets, or any other relatively-flexible substrate that contain filtration media particles, as described herein, can be folded, pleated, wound, or manipulated in any other manner to define a chemically active filter insert for incorporation into chemical filters of the present invention.

The particles can be formed primarily from a strong base material itself. By "strong base" is meant a base that will displace the weak base from the neutral salts and return the weak base to the oil for recirculation to the piston ring zone where the weak base is reused to neutralize additional acids. Examples of suitable strong bases include, but are not limited to, barium oxide (BaO), calcium carbonate ($CaCO_3$), calcium oxide (CaO), calcium hydroxide ($Ca(OH)_2$) magnesium carbonate ($MgCO_3$), magnesium hydroxide ($Mg(OH)_2$), magnesium oxide (MgO), sodium aluminate ($NaAlO_2$), sodium carbonate ($Na_2CO_3$), sodium hydroxide (NaOH), zinc oxide (ZnO), zinc carbonate ($ZnCO_3$) and zinc hydroxide $Zn(OH)_2$ or their mixtures. Magnesium oxide and zinc oxide are preferred strong base materials, and one preferred mixture of strong base materials includes the combination of magnesium oxide and zinc oxide.

Figure 5:
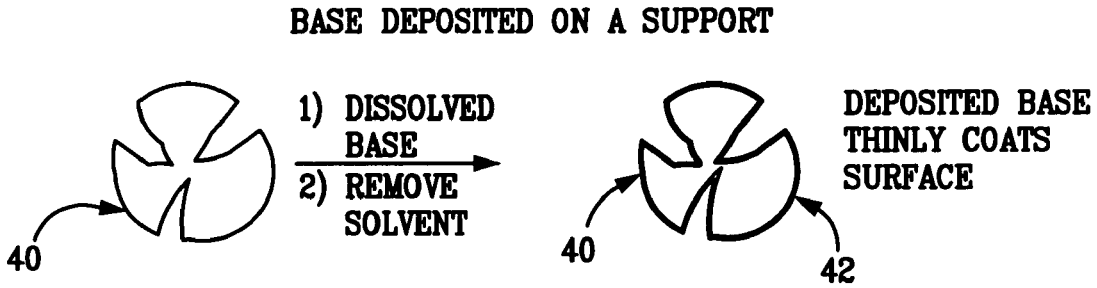
FIG. 5 is a schematic of a filtration media particle that includes a substrate particulate and a layer of a strong base material disposed thereon.

The particles can alternatively be formed from a substrate material onto which a strong base material is disposed. The strong base may be incorporated on or with the substrate by methods known to those skilled in the art. For example, substrate particles can be exposed to a solution of dissolved strong base material and a solvent so that the solution coats the exterior and interior surface areas of the particles. The solvent is then removed, leaving a thin layer of strong base material disposed on the substrate particles. FIG. 5 is a simplified schematic illustrating this process, wherein a substrate particle 40 is coated with a thin layer of a strong base material 42. Suitable substrates 40 include, but are not limited to, activated carbon, carbon black, activated or transition alumina, silica gel, aluminosilicates, layered double hydroxides, micelle templated silicates and aluminosilicates, manganese oxide, mesoporous molecular sieves, MCM-type materials, diatomaceous earth or silicas, green sand, activated magnesite, adsorbent resins, porous clays, montmorillonite, bentonite, magnesium silicate, zirconium oxide, Fuller's earth, cement binder, aerogels, xerogels, cryogels, metal-organic frameworks, isoreticular metal-organic frameworks, and mixtures thereof. Activated carbon has been found to be a preferred substrate on which to deposit a very thin or monolayer of a strong base material. For this purpose it is useful (although not required) that the carbon surface is acidic. In accordance with the preferred embodiments, having a strong base material "associated" with particulate filtration media includes embodiments where the particles are primarily made from the strong base material itself, as well as embodiments where the strong base material is disposed onto substrate particles (which material itself may or may not contribute to the strong base functionality).

It should be noted that many of the above-listed substrates are physically active materials, and that alternative chemical filter and/or insert embodiments of the present invention employ mixed filtration media-both chemically and physically active filtration media. For example, a volume of activated carbon can be employed in a chemical filter, and only a portion of the carbon particles be coated with a strong base material. The uncoated carbon particles would serve as physically active filtration media capable of adsorbing any number of oil contaminants, and the coated particles serve as chemically active filtration media capable of immobilizing combustion acids and recycling lubricant dispersants in accordance with the invention. The mixed filtration media can be formed into a single solid structure with binder material. Alternately, the physically active particles could be bound into a first insert or component and the chemically active particles bound into a second insert or component, with the two components assembled within a chemical filter housing.

The amount of strong base material required will vary with the amount of weak base in the oil and the amount of acids formed during engine operation. However, since the strong base material is not being continuously regenerated for reuse as is the weak base material, the amount of strong base material is preferably at least equal to the equivalent weight of the weak base in the oil, and more preferably two or more times the weight of the weak base employed in the oil.

The exchange between strong base and weak base is a surface phenomenon. Molecules of strong base that are not located at an accessible surface are therefore unavailable for exchange with a weak base. A particle of strong base that is non-porous, i.e. with only exterior surface area, would have little surface area and would likely be inefficient for exchange with a weak base. Only those molecules at the surface would be available for exchange and all non-surface molecules of strong base would be unusable. Porous filtration media particles—those having internal pores—accordingly are preferred. As the porosity of a particle increases, the total surface area, i.e. the exterior plus interior surface area (as defined by internal pores), greatly increases. At some measure of porosity the exterior surface area becomes inconsequential. For particles of optimum porosity, where the exterior surface area is inconsequential, the particle size is best chosen for considerations of minimizing pressure drop through the filter and for ensuring the structural integrity of the filter bed. The particles preferably range from about 50 nanometers to about 25 micrometers. If the particles have an effective diameter that is less than about 5 micrometers, then it is generally preferred that the particles be bound into aggregate particles or into a solid structure because the inactive size-exclusion filter members required to immobilize smaller particles would impose a large pressure drop across the filter, and it is desirable to contain the particles within the chemical filters of the present invention.

Not all interior surface area is available for immobilizing combustion acids. It is necessary that the combustion acid-weak base complex be able to enter into the internal pore to access the interior surface area that includes a strong base material. When contact with the strong base occurs, the combustion acid-weak base complex ion exchanges with the strong base, the combustion acid remains immobilized on the surface, and the regenerated weak base returns to solution. Maximizing usable surface area maximizes the capacity of the strong base material. Thus, a limitation to complete surface utilization is that of size exclusion of the weak base by a small pore or small pore entrance. Namely, the weak base must fit into the pore or through a size-restrictive pore entrance. As a result, the weak base solution phase diameter of gyration determines the smallest functional pores. The radius (or diameter/2) of gyration of an object is the radius of a thin-walled hollow cylinder that has the same mass and the same moment of inertia as the object in question.

One widely used dispersant (weak base) is provided by condensation of polyisobutylene succinic anhydride and a branched poly(alkylene amine) ("PAM"). This dispersant can be considered as a short block copolymer with oleophilic PIB chains at the ends and a polar PAM segment in the middle. The solution phase diameter of gyration in a random walk configuration of this material has been estimated at 62 Angstroms (see Langmuir 2005, 21, 924-32, "Effect of Temperature on Carbon-Black Agglomerates in Hydrocarbon Liquid With Adsorbed Dispersant", You-Yeon Won, Steve P. Meeker, Veronique Trappe, and David Weitz, Department of Physics and DEAS, Harvard University; Nancy Z. Diggs and Jacob I. Emert, Infineum USA LP). Although not typically present in commercial formulations, trioctadecylamine also functions as a weak base. It could be added to a lubricant to serve this purpose. The solution phase diameter of gyration of this molecule may be estimated at 55 Angstroms by summing C—C and C—N bond lengths, and using the following information and calculation:

C—C bond length=1.54 Angstroms

C—N bond length=1.47 Angstroms $$2\times(17\times1.54\ \text{Å}+1.47\ \text{Å})=55\ \text{Å}$$

While these two weak bases are presented as examples, suitable weak bases with somewhat smaller diameters of gyration are possible, and filtration media having internal pores tailored for accepting these other weak bases is within the scope of the present invention.

Figure 6:
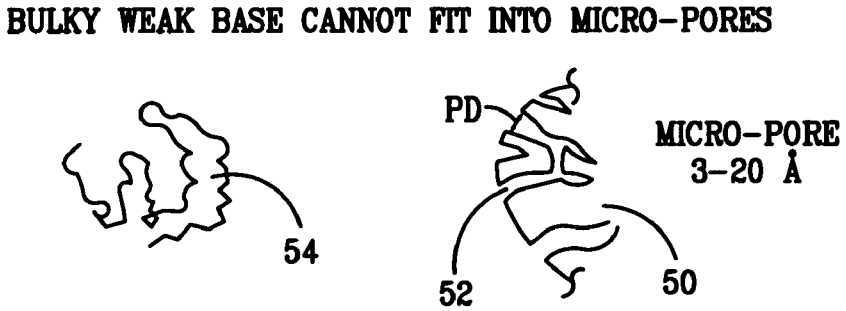
FIG. 6 illustrates relative size comparisons between typical weak base molecules and porous particles having micropores of an insufficient diameter to receive the weak base.

Accordingly it is believed that an internal pore diameter of less than 60 Angstroms will allow very few traditional weak bases to access the pore surface area because of size exclusion. FIG. 6 illustrates this scenario, where a porous particle 50 has internal pores 52 having a diameter PD that is much too small (<<60 Angstroms) to accept a bulky weak base molecule 54. An internal pore diameter of 80 Angstroms or greater is believed to allow a significant portion of the combustion acid-weak base complexes to access the interior surface of a pore. An internal pore diameter of 200 Angstroms or greater is believed to allow the vast majority of weak base-combustion acid complexes to access the interior surface of a pore. However, internal pores can become so large, that the structural integrity of the filtration media particles can become compromised. The upper limit of internal pore diameter varies with manufacturing techniques and applications. In one embodiment, the filtration media particles define filtration media pores (internal pores plus interstitial pores formed between adjacent particles) with a median pore diameter between about 60 Angstroms and about 3,000 Angstroms. It should be noted that pore diameters larger than 3,000 Angstroms are suitable for the present invention, so long as structural integrity may be maintained.

Filtration media particles of the present invention preferably provide a relatively large amount of available surface area for the weak base—strong base exchange; i.e., a surface area that is substantially derived from pores (internal pores defined within a particle and interstitial pores defined between adjacent particles) that are large enough to accept a combustion acid-weak base complex. In one embodiment, the filtration media has a surface area that is greater than or equal to about 25 $m^2$/gm derived from internal pores and interstitial pores that are capable of receiving a combustion acid-weak base complex (see, e.g., Magchem 30 brand magnesium oxide that is characterized in FIG. 18). In another embodiment, the filtration media has a surface area that is greater than or equal to about 30 $m^2$/gm derived from internal pores and interstitial pores that are capable of receiving a combustion acid-weak base complex (see, e.g., Premium brand magnesium oxide that is characterized in FIG. 18). In yet another embodiment, the filtration media has a surface area that is greater than or equal to about 50 $m^2$/gm derived from internal pores and interstitial pores that are capable of receiving a combustion acid-weak base complex (see, e.g., Magchem 40 brand magnesium oxide that is characterized in FIG. 18). A preferred methodology for measuring the surface area in accordance with the preferred embodiments is mercury intrusion porosimetry. Mercury porosimetry utilizes the Washburn equation to calculate pore size information from measured pressures. The volume is calculated by converting measured capacitance to volume. The data reported generally includes total pore area, bulk density, skeletal density, porosity, average pore diameter, median pore diameter, and total intrusion volume.

In accordance with the above discussion, morphology of the filtration media employed in chemical filters of the present invention is important. Filtration media with limited total surface area is undesirable. It has been found that some strong bases, for example, limestone and several forms of magnesium and zinc oxide, have very few internal pores and thus very low surface area (see FIGS. 15-18). Media having a high BET surface area value may be unsuitable as well since this technique measure very small unsuitable pores in addition to larger pores. Filtration media having a significant number of internal pores may also be undesirable if a significant number of the internal pores are too small to accept a weak base-combustion acid complex. For example, the prior art (see, e.g., U.S. Pat. No. 4,894,210) discloses Catalyst 75-1 (zinc oxide) as having a BET surface area of 80 $m^2$/gm, but the calculation in the background section of this application estimates that the surface area available for accepting a combustion acid-weak base complex is only 15-21 $m^2$/gm due to the number of small pores in Catalyst 75-1.

Figure 7:
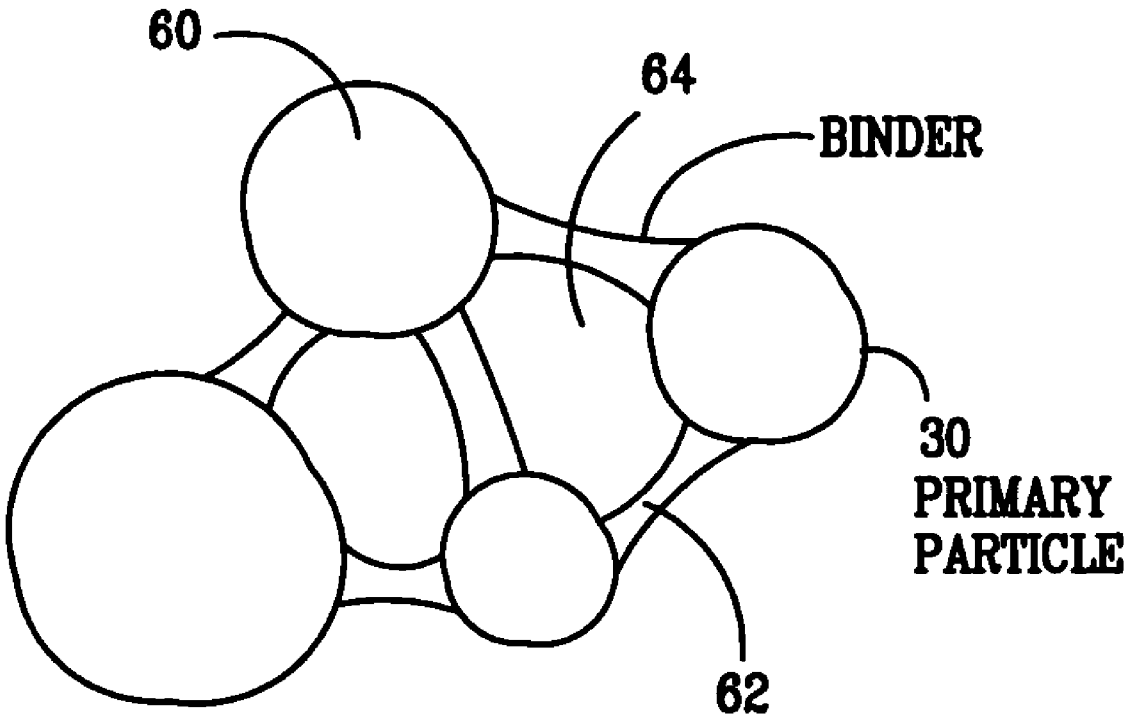
FIG. 7 is a schematic of a portion of filtration media provided by the present invention, including particles (having an associated strong base material) and binder material that may form a substantially continuous binder matrix and that spans and binds adjacent particles.

Filtration media particles are preferably bound together with a binder material, as is shown in FIG. 7. In one embodiment, the filtration particles and binder material are formed into monolithic structures. One reason for this is to prevent settling of primary filtration media particles that can result in channeling of lubricant flowing through the filtration media. Another reason for binding the particles is due to their size. Many strong base particles are smaller than 5 microns (effective diameter), and could potentially enter the lubrication stream since even traditional by-pass inactive size-exclusion filter members have about a 5 micron limitation. FIG. 7 shows primary particles 60 bound with binder 62. Importantly, binder 62 does not completely fill the spaces created between adjacent particles 60 because interstitial pores 64 are required for diffusion of oil through the filtration media. Binder material 62 may be discreet strands or particles which span and bind adjacent chemical filter particles 60 or form a substantially continuous porous binder matrix that encloses and binds adjacent chemical filter particles 60.

Useful binders include, but are not limited to, polyolefins, polyvinyls, polyvinyl esters, polyvinyl ethers, polyvinyl sulfates, polyvinyl phosphates, polyvinyl amines, polyoxidiazoles, polytriazols, polycarbodiimides, polysulfones, polycarbonates, polyamides, polyethers, polyarylene oxides, polyesters, polyvinyl alcohols, polyacrylates, polyphoshazenes, polyurethanes, polyethylenes, polypropylenes, polybutene-1, poly-4-methylpentene-1, poly-p-phenylene-2, 6-benzobisoxazole, poly-2,6-diimidazo pyridinylene-1,4 (2,5-dihydroxy) phenylene, polyvinyl chlorides, polyvinyl fluorides, polyvinylidene chlorides, polyvinyl acetates, polyvinyl proprionates polyvinyl pyrrolidones, polysulfones, polycarbonates, polyethylene oxides, polymethylene oxides, polypropylene oxides, polyarylates, polyethylene terephthalate, polypara-phenyleneterephthalamide, polytetrafluoroethylene, ethylene-vinyl acetate copolymers, polyurethanes, polyimides, polybenzazoles, para-Aramid fibers, polymer colloids, latexes, and mixtures thereof Preferred binders are selected from the group comprising low density polyethylene, high density polyethylene, ethylene-vinyl acetate copolymer, nylon, and mixtures thereof. Nylon is an especially preferred binder, with Nylon 11 (available from Arkema as Rilsan® polyamide 11) being most preferred.

The binder may also be a thermoset material. Preferred thermoset binders include phenolformaldehyde resin and melamine resin. Inorganic binder materials are also contemplated by the present invention. A representative, non-limiting list of inorganic binders includes silica, alumina, aluminates, silicates, reactive oxides, aluminosilicates, metal powders, volcanic glass and clays. Particularly preferred clays are kaolin clay, meta-kaolin clay, attapulgus clay, and dolomite clay. In one embodiment, filtration media particles are immobilized within a monolithic structure created by the addition of a polymeric organic binder and an inorganic binder.

The binder materials and the filtration media particles (strong base powder or substrate powder having a strong base material disposed thereon) can be combined using various techniques known by one skilled in the art. Two techniques suitable for combining the binder materials and the filtration media particles are disclosed in U.S. Pat. Nos. 5,019,311 and 5,928,588, both of which are incorporated in their entirety herein by reference. These patents also disclose other suitable binder materials that can be employed with filtration media particles of the present invention.

Figure 8:
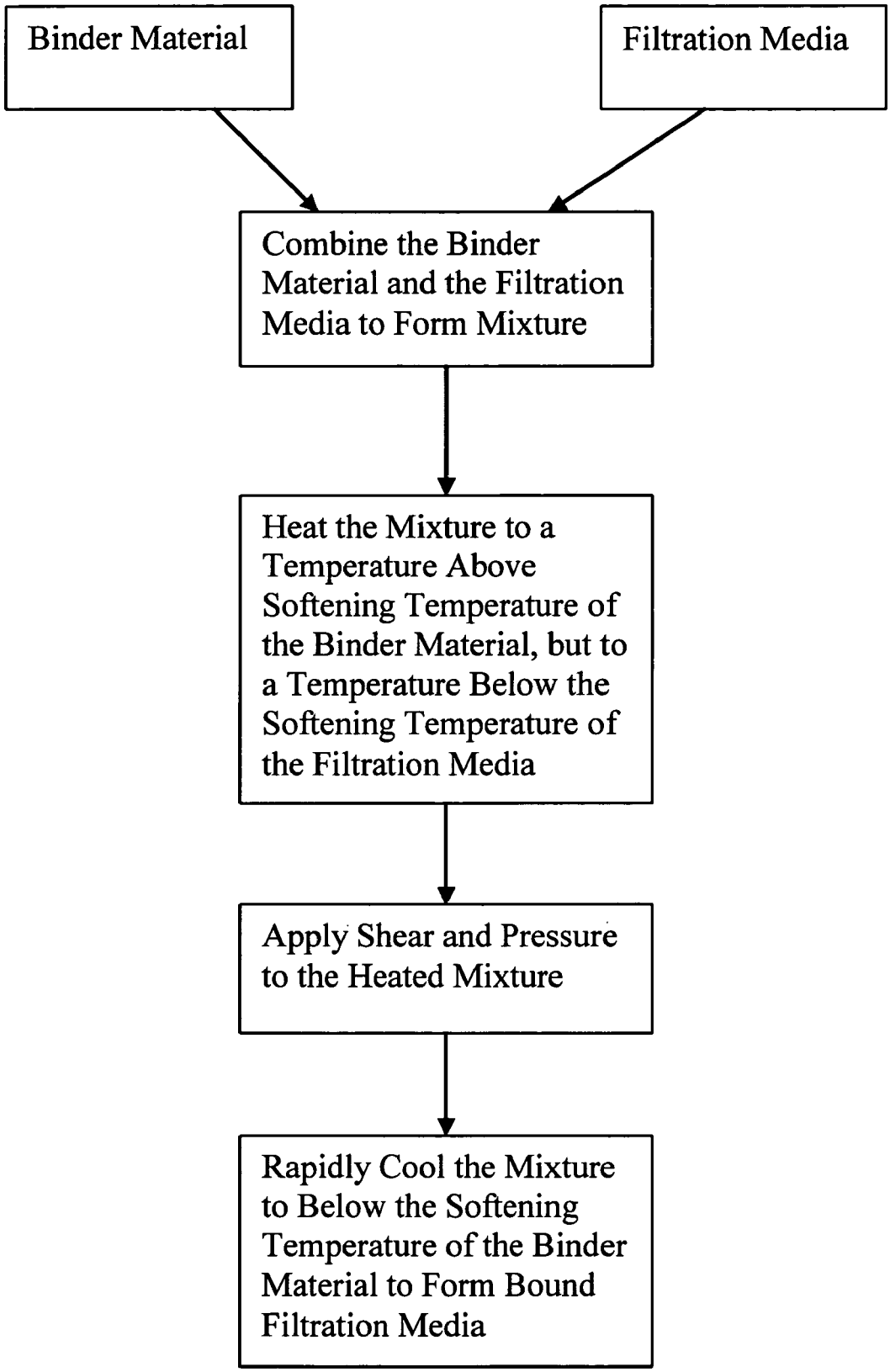
FIG. 8 is a diagrammatic showing a first method for making bound filtration media in accordance with the present invention.
Figure 9:
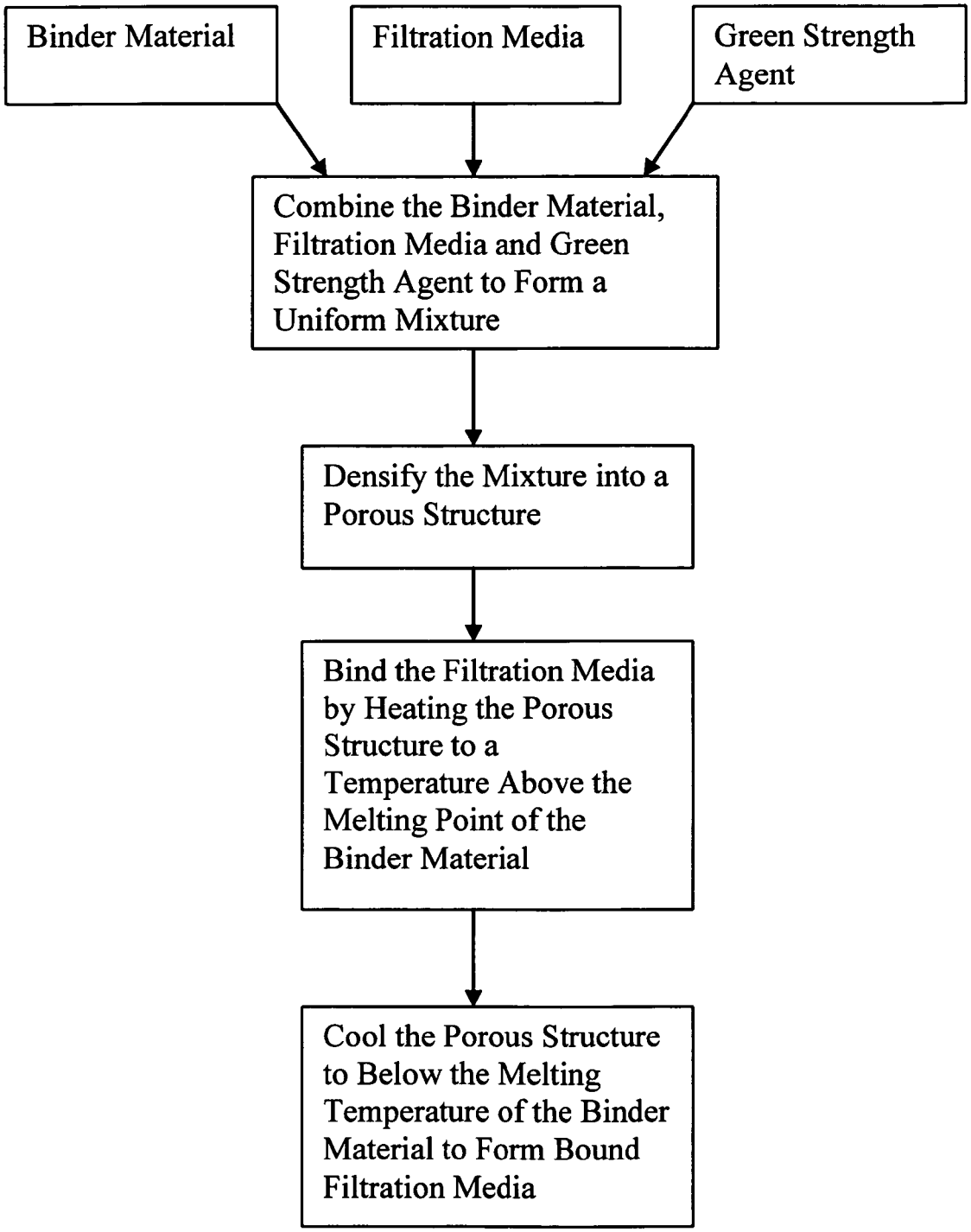
FIG. 9 is a diagrammatic depicting a second method for making bound filtration media in accordance with the present invention.

Two preferred methods for making bound filtration media are shown in FIGS. 8 and 9. A first method, shown in FIG. 8, includes combining filtration media and binder material to form a mixture. The mixture is heated to a temperature that is above the softening temperature of the binder material, but is below the softening temperature of the filtration media. Shear and pressure are applied to the heated mixture. In one embodiment, a sufficient amount of shear and pressure are applied to convert at least some of the binder material into a substantially continuous webbing structure. The filtration media particles and binder material can be selected from the above discussion of suitable materials.

The method illustrated in FIG. 9 includes combining filtration media binder material, and a green strength agent into a substantially uniform mixture. The mixture is then densified into a porous structure. The porous structure is heated to a temperature above the melting point of the binder material, resulting in the binder material flowing and contacting adjacent filtration media particles. The porous structure is then rapidly cooled to a temperature below the melting point of the binder material. The filtration media particles and binder material can be selected from the above discussion of suitable materials. The green strength agent can be in the form of a powder, fibers, liquids, or mixtures thereof. A representative list of suitable fibers includes fibrillated or micro-fibers selected from the group consisting of polyolefin fibers, polyesters, nylons, aramids, and rayons. Suitable liquids include, but are not limited to, latexes and resin solutions.

Agglomerations (e.g., in the form of a "pellet") of primary particles and binder material can be made, and the agglomerations contained within a chemical filter through various means, such as a mesh cage or liquid permeable fibrous mat (e.g., filter paper, a woven fibrous web, or a nonwoven web). Chemically active filter members to be inserted into a chemical filter can be formed into solid, porous structures using various techniques, including the methods shown and described with reference to FIGS. 8 and 9, as well as those disclosed in the U.S. Pat. Nos. 5,019,311 and 5,928,588.

One preferred porous structure, which can be made with the above-disclosed methods, includes filtration media particles, including but not limited to those described above, and a matrix of thermoplastic binder supporting and enmeshing the filtration media particles. The matrix of thermoplastic binder is preferably a substantially continuous thermoplastic binder phase that supports and enmeshes the filtration media particles. The substantially continuous thermoplastic binder phase is preferably formed from binder materials that are substantially incapable of fibrillation under normal conditions (i.e., ambient conditions known to those skilled in the art) into micro fibers having a diameter of less than about 10 micrometers and that have a softening temperature substantially below that of the filtration media particles. The filtration media particles may be consolidated into a uniform matrix within the substantially continuous thermoplastic binder phase that is present as a dilute material within interstitial pores between the filtration media particles. The remainder of the pore volume includes a continuous volume of voids and the binder material being forced into macropores and exterior voids of individual filtration media particles.

Another preferred porous structure, which can be made with the above-disclosed methods, includes filtration media particles, including but not limited to those described above, a component providing binding capability, and a component providing green strength reinforcement capability. The component providing binding capability can include any of the binder materials disclosed herein, and is preferably selected from the group comprising a thermoplastic, a thermosetting polymer, an inorganic binder, and mixtures thereof. An exemplary embodiment includes from about 70 to about 90 weight percent of filtration media particles, from about 8 to about 20 weight percent of the component providing binding capability, and from about 1 to about 15 weight percent of the component providing green strength reinforcement capability. The porous structure may optionally include a component selected from the group comprising a cationic charged resin, an ion-exchange material, perlite, diatomaceous earth, activated alumina, zeolites, resin solutions, latexes, metallic materials and fibers, cellulose, carbon particles, carbon fibers, rayon fibers, nylon fibers, polypropylene fibers, polyester fibers, glass fibers, steel fibers, graphite fibers, and mixtures thereof.

The solid, porous structures can have numerous configurations and dimensions, with one preferred structure being a cylinder that can be placed radially inward or outward from an inactive size-exclusion filter member housed within a filter canister, resulting in a chemical filter of the present invention. The structures can be formed into a first configuration and then manipulated into a second geometry prior to incorporation into a chemical filter canister or other housing. For example, a solid, porous sheet can be formed that includes particles and binder material, and the sheet then formed into a cylinder or spirally wound to define multiple radially disposed layers.

The preferred placement of chemical filters of the present invention is the location of traditional oil filters (full-flow and/or by-pass) of an internal combustion engine lubrication system. Other locations within a lubrication system are contemplated by the present invention. With the preferred placement, the traditional filters are replaced or combined with the chemical filters of the present invention. Obviously, with the preferred placement, an inactive size-exclusion filter member is required along with the chemically active filtration media comprising a strong base material as described above. The chemically active filtration media may be oriented within a chemical filter canister or other housing in several ways. It may be placed upstream of the inactive size-exclusion filter member wherein any fines released by the chemically active filtration media would be isolated by size exclusion filtration. It may be placed downstream of the inactive size-exclusion filter member wherein particles are first removed by the size-exclusion filter before any pores in the chemically active filtration media are obstructed by suspended particles. It may also be placed before and after the inactive size-exclusion filter. A single filter member may also be defined that acts as both a size-exclusion filter and a chemically active filter. For example, a chemically active filtration media can be engaged with a filter paper sheet, and the sheet wound around a central mandrel to give alternating layers of chemical filter and size-exclusion filter as outlined in U.S. Pat. Nos. 5,792,513; 6,077,588; 6,355,330; 6,485,813; or 6,719,869. In addition to a backing sheet, a cover sheet may be utilized as well. Flow of the lubricant through chemical filters of the present invention may have various flow patterns, including radial and axial.

Figure 10:
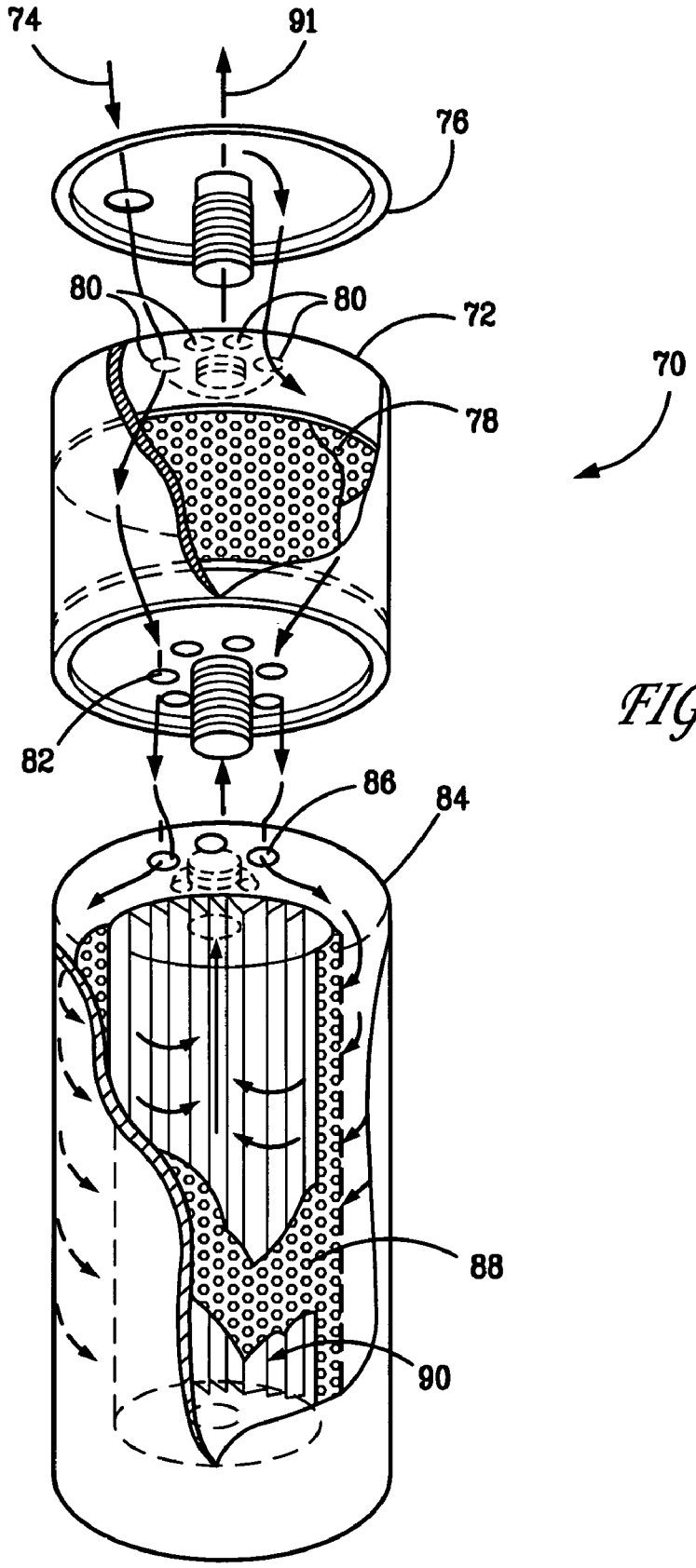
FIG. 10 is perspective view of a two-stage chemical filter in accordance with the present invention.

As discussed above, FIG. 2 is one exemplary chemical filter provided by the present invention. The skilled artisan would generally characterize chemical filter 10 as a single stage filter. Alternative chemical filters of the present invention may define or be incorporated into multiple stage filtration. By way of example and with reference to FIG. 10, another exemplary chemical filter 70 is shown in the configuration of a two-stage filter. Oil initially flows into a first stage 72 through an opening 74 disposed in cover 76. Oil is then distributed to filtration media 78 via inlets 80. Filtration media 78 preferably comprises the filtration media (with strong base) described throughout the remainder of the specification. Oil exits first stage 72 through outlets 82 and into a second stage 84 via inlets 86. Second stage 84 includes an annular arrangement of filtration media 88 surrounding an inactive size-exclusion filter member 90. Filtration media 88 preferably includes a strong base material and may be physically and chemically similar or dissimilar to filtration media 78. By way of example only, filtration media 78 can include zinc oxide while filtration media 88 includes magnesium oxide. Oil flows radially inward through filtration media 88, through inactive size-exclusion filter member 90, and then exits the second stage via a central exit 91.

Figure 11:
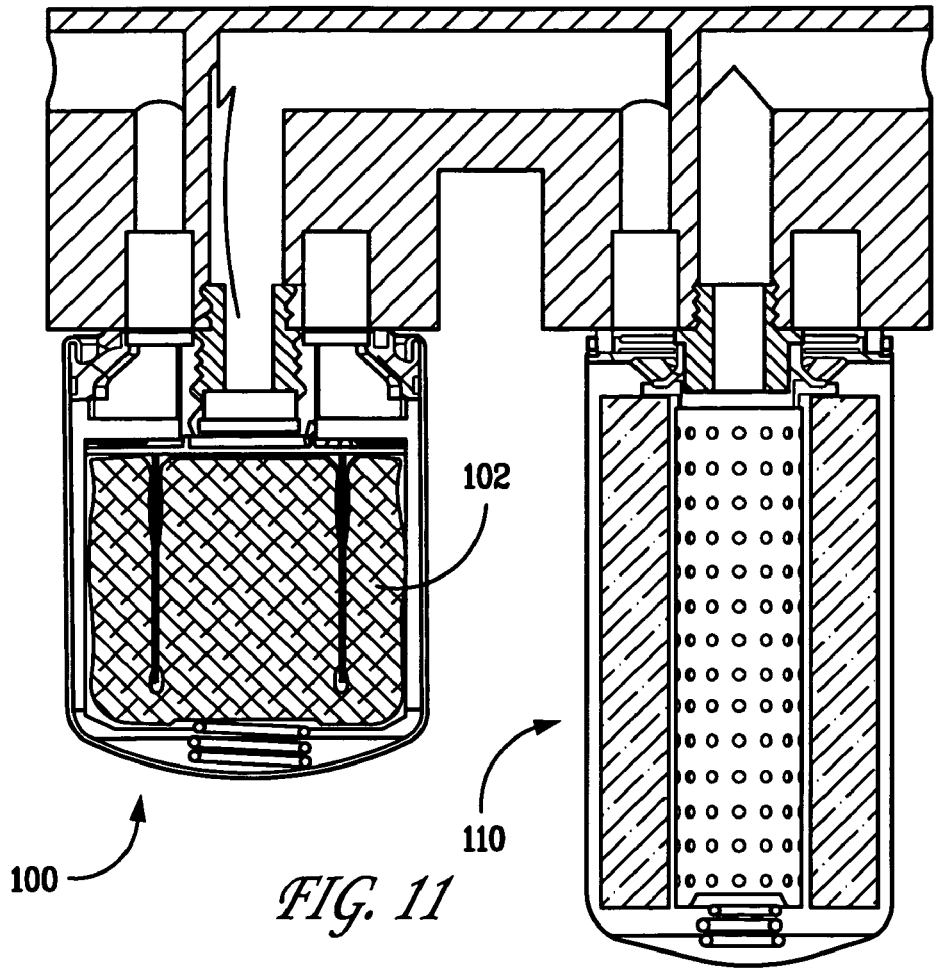
FIG. 11 is a cross-sectional view of a portion of a lubrication system for an internal combustion engine, the lubrication system includes a chemical filter provided by the present invention, and a traditional inactive size-exclusion filter member that is spaced apart from the chemical filter.

As illustrated in FIG. 11, an independent chemical filter 100 can be placed in the lubrication system for an internal combustion engine, whereby oil is circulated serially through both an inactive size-exclusion filter, for example, filter 110, and an independent chemical filter 100. Oil can flow through either filter first. Chemical filter 100 contains chemically active filtration media 102 that includes a strong base material in accordance with the description herein.

Figure 12:
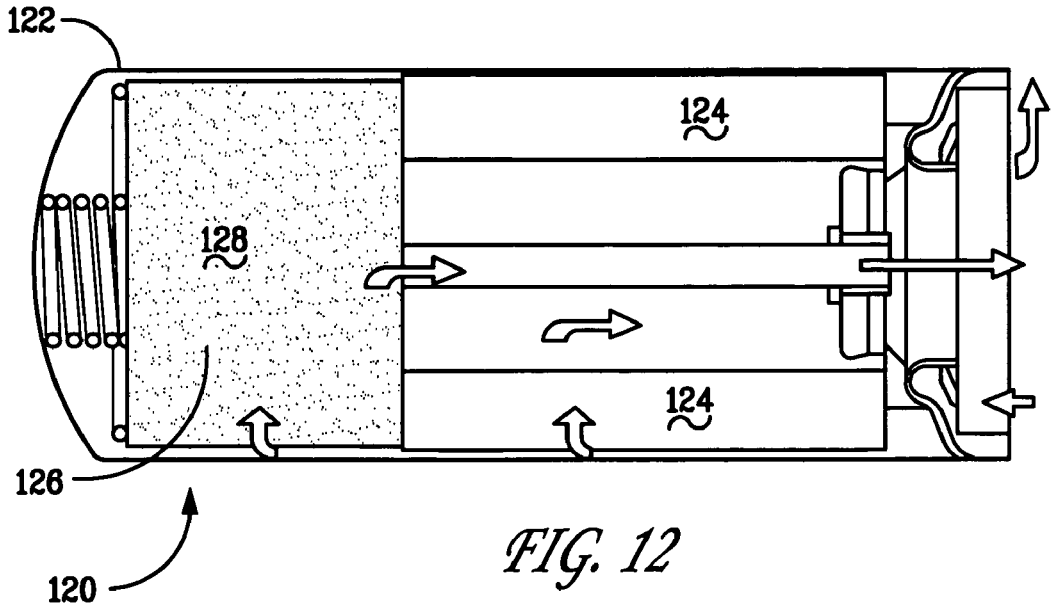
FIG. 12 is a cross-sectional view of an exemplary chemical filter of the present invention, the chemical filter includes an inactive size-exclusion filter member arranged end-to-end with a chemically active filter member or insert that operates in a by-pass mode.

In alternate chemical filter embodiments of the present invention, chemically active filter members can be arranged substantially end-to-end with an inactive size-exclusion filter member, in contrast to the radial placement that is shown in FIG. 2. With reference to FIG. 12, an exemplary chemical filter 120 is shown including a housing 122, an inactive size-exclusion filter member 124 disposed in housing 122, and a chemically active filter member 126 disposed at one end of inactive size-exclusion filter member 124. Chemically active filter member 126 includes filtration media 128 having an associated strong base material in accordance with the present invention. This embodiment may or may not include a Venturi nozzle.

With an end-to-end arrangement, a complete full flow scenario can be realized whereby all of the oil flows through the inactive size-exclusion filter member 124 and the chemically active filter member 126. Alternatively, a variety of by-pass flow scenarios can be accomplished so that a portion of incoming oil flows only through one or more inactive size-exclusion filter members, and the remaining portion flows through the chemically active filter member. In other embodiments, a first portion of the incoming oil flows through only the chemically active filter member, a second portion of the incoming oil flows through only the inactive size-exclusion filter member, and a third portion of the incoming oil flows through both filter members.

The chemical filter overall configuration and included features are not critical to the present invention. Accordingly, the above description and corresponding figures are included for illustration purposes only, and the presence or absence of features should not be read into a proper construction of the appended claims.

Another way to create high surface area discussed within the context of this disclosure is to generate very small substantially solid non-porous particles of a strong base material. The particles would preferably be in the nanometer size range. These nanometer-sized particles could be agglomerated using a binder or adhesive to form a porous (defined by interstitial pores between adjacent particles) solid. This structure provides a high surface area filtration component. The structure would likely have little or no internal surface area until the particles were coalesced, but after would be suitable for the application described and disclosed herein. The nanometer-sized strong base particles could also be dispersed and/or adsorbed onto a suitable porous substrate (as described above).

For example, spherical particles of magnesium oxide that have a diameter of one nanometer would have an approximate external surface area of 280 $m^2$/gm. Those having a diameter of five nanometers would have an approximate external surface area of 56 $m^2$/gm. If the geometries were non-spherical and irregular, the surface areas could be considerably higher. Spherical particles of zinc oxide that have a diameter of 1 nanometer would have an approximate external surface area of 178 $m^2$/gm and those having a diameter of 5 nanometers would have an approximate external surface area of 36 $m^2$/gm. Again, if the geometries were non-spherical and irregular, the surface areas could be considerably higher.

In order to reduce emissions, engine manufacturers have begun employing a technology known as Exhaust Gas Recirculation ("EGR"). This technology recycles exhaust back into the combustion chamber. A schematic of the main components of an EGR system is depicted in prior art FIG. 13.

One portion 130 of the exhaust exits the vehicle as it normally would, while another portion 132 of the exhaust is routed through an EGR valve 134. Recovered exhaust gases 132 are then cooled with an oil cooler 136, for example, before being combined with clean air 138 introduced at the air/fuel mixture intake 140. This combination air/fuel mixture is delivered to a combustion chamber 142.

Figure 13:
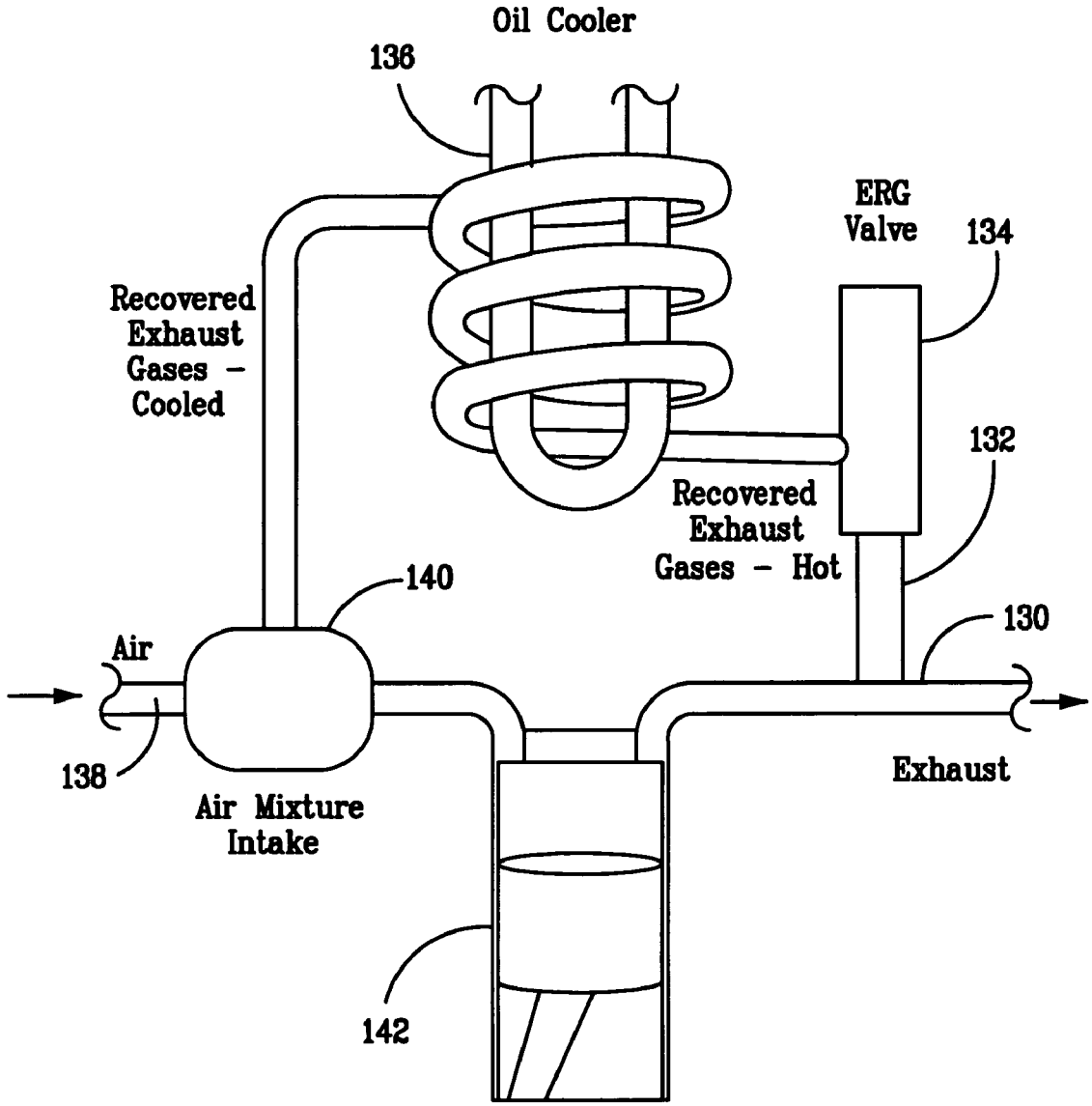
Prior Art FIG. 13
FIG. 13 is a schematic of an exhaust gas recirculation system that is known in the art.
Figure 14:
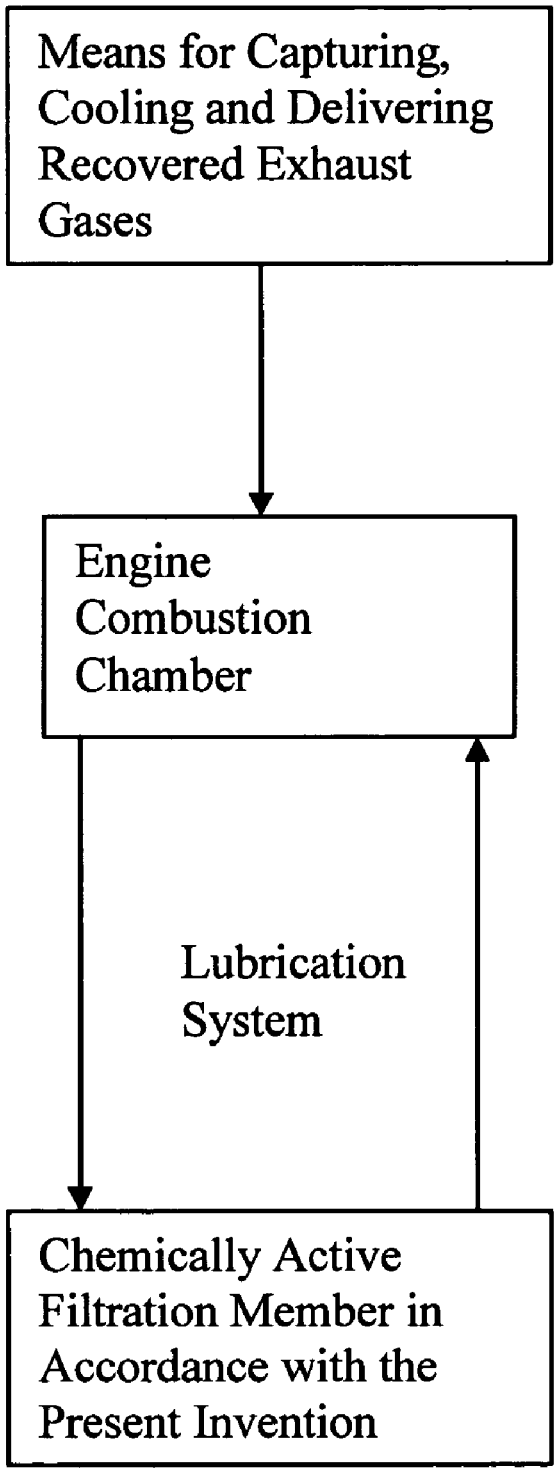
FIG. 14 is a diagrammatic depicting a system embodiment for controlling combustion by-products in accordance with the present invention.

Chemical filters of the present invention are particularly useful for vehicles incorporating EGR technology. Accordingly, systems for controlling combustion by-products are provided by the present invention. FIG. 14 is a diagrammatic of one preferred system embodiment. The means for introducing recovered exhaust gas into the combustion chamber can be any of those known to one skilled in the art, including the conduits, EGR valve and oil cooling components that are shown in FIG. 13. The chemically active filtration member included in this preferred embodiment includes filtration media having internal pores with a median pore diameter that is at least about 60 Angstroms, and a surface area greater than or equal to about 25 $m^2$/gm. Another preferred system embodiment includes a means for introducing recovered exhaust gas into the combustion chamber that would otherwise be emitted to the atmosphere and an engine lubrication system containing lubricating oil having a weak base therein, a chemically active oil filter disposed within the lubrication system and physically active filtration media disposed in the engine lubrication system to remove contaminants associated with the recovered exhaust gas. The chemically active oil filter includes filtration media comprising particles having internal pores and a strong base material associated with at least some of the internal pores. Note that alternative system embodiments include chemical filters and chemically active filtration media as discussed throughout the remainder of the specification.

Methods for managing lubricant contaminants flowing through a lubrication system of an internal combustion engine utilizing recovered exhaust gas are provided. In one embodiment, the method includes the steps of (a) filtering the lubricant with physically active filtration media, such as, for example, activated carbon, and, (b) filtering the lubricant with chemically active filtration media that comprises a strong base material. Step (a) is conducted prior to step (b) so that adsorption of combustion by-products, other than weak base-combustion acid complexes, onto the filtration media comprising a strong base is minimized.

EXAMPLES

Several candidate strong base materials were investigated for suitable application in chemical filters of the present invention. Gas adsorption and mercury porosimetry methodologies were utilized to characterize the porosity and surface area characteristics of the candidate materials, as described below.

Sample Preparation

In order to ensure that all porosity is accurately accounted and measured, formed, bound, or solid materials must be ground into a fine powder whose particle size is that of the primary particles before running the pore analysis. To determine whether or not the transformed material is sufficiently ground prior to assessing its porosity, electronic micrograph results of the ground material can be compared to the porosimetry results. The transformed material is sufficiently ground when the electron micrograph results indicate pores sizes substantially equivalent to the pore sizes measured via porosimetry techniques. This sample preparation is intended to prevent ink bottle, shielding, and skin effects commonly associated with the interstitial pores of such materials. The analysis is preferably conducted on the chemical filtration material prior to the addition of binders (i.e., the chemical filtration material as supplied by the manufacturer).

Gas Adsorption for Pore Size

A reasonable effort must be taken to remove adsorbed gases and moisture from the material, yet not change particle morphology. While specific procedures will vary depending upon the material, the following procedures were used for magnesium oxides and zinc oxides.

MgO: Preheat the sample to 180 degrees C. under flowing dry nitrogen or nitrogen/helium mix and hold for 0.5 hours. Following, cool the sample for 10 minutes and ensure it stabilizes at the measurement temperature.

ZnO: Preheat the sample to 150 degrees C. under flowing nitrogen or nitrogen/helium mix and then hold for 1.5 hours. Following, cool the sample for 10 minutes and ensure it stabilizes at the measurement temperature.

Gas Adsorption Measurements: Pore size distribution and BET surface area was determined by Micromeritics Analytical Services of Norcross, Ga. using nitrogen gas adsorption. Isotherms were recorded from low pressures to saturation pressure utilizing a Micromeritics Tristar 3000 instrument. Isotherm curves, expressed as a series of pressure vs. quantity adsorbed data pairs, were then analyzed to determine surface area utilizing the multi-point BET method.

Mercury Intrusion Porosimetry

Pore size distribution was determined by Micromeritics Analytical Services of Norcross, Ga. using mercury intrusion porosimetry. Void volume and the corresponding pressure (or pore size) was recorded utilizing a Micromeritics Autopore IV 9520 instrument. Mercury intrusion data were then analyzed to determine pore volume distribution of pores between 330 and 0.003 micrometers in diameter. Mercury porosimetry utilizes the Washburn equation to calculate pore size information from the pressure measured. The volume is calculated by converting measured capacitance to volume. The data reported includes total pore area, bulk density, skeletal density, porosity, average pore diameter, median pore diameter, and total intrusion volume.

The porosity and surface area characteristics of the candidate strong base materials are shown in FIGS. 15-18. FIG. 15 includes porosity calculations of prior art material Catalyst 75-1, as described above. FIG. 16 includes unsuitable magnesium oxide and zinc oxide candidate materials; FIG. 17 includes limestone materials believed unsuitable for this application. The strong base materials in FIGS. 16 and 17 have such a low reported total surface area, that even if all of the surface area was derived from pores sized adequately for accepting combustion acid-weak base complexes, the strong base materials would likely be ineffective for increasing the time between oil drains.

FIG. 18 includes a representative, non-limiting list of suitable and preferred strong base materials in accordance with the present invention. The usable surface (for this application) of the materials included in FIG. 18 ranges from a value that is equal to or greater than about 25 $m^2$/gm (26-27 $m^2$/gm for Magchem 30) to a value that is equal to or greater than about 50 $m^2$/gm (50-61 $m^2$/gm for MagOx 98 HR). Several candidate materials have usable surface area values in the 30's ($m^2$/gm). Magchem 50 (MgO), available from Martin Marietta, is a particularly preferred strong base material.

In addition to the discussion in the Background Section regarding Catalyst 75-1, the table in FIG. 18 illustrates that the BET surface area, which is a surface area value commonly reported by suppliers, is not necessarily indicative of how much usable surface area (for this application) a particular strong base material provides. For example, the manufacturer of Magchem HSA 30 reports that the material has a BET surface area of 160 $m^2$/gm. However, much less than half of the BET surface area is derived from pores that are large enough to accept a combustion acid-weak base complex (62 $m^2$/gm usable surface area derived from pores 1066 to 60 Å), a step necessary for immobilizing combustion acids. Further, nearly half of the remaining usable surface area (62 $m^2$/gm) of HSA 30 resides in pores with relatively small openings in the size range of 60 to 80 Å. Since there is typically variability in the weak base molecular weight (and thus the solution phase diameter of gyration), molecules that fall into the large end of the distribution may only fit into pores greater than 80 Å. Thus, the functional surface area of a seemingly highly effective material like HSA 30 actually approaches a more modest 32 $m^2$/gm. This derives from the fact that this material has a median pore diameter of 55 Å. In contrast, a material like Magchem 50 has a much lower BET surface area (65 $m^2$/gm reported by the manufacturer), but nearly all of the surface area resides within pores that are accessible to even large combustion acid-weak base complexes (64 $m^2$/gm usable surface area derived from pores 1066 to 80 Å). This derives from the material's much larger median pore diameter of 141 Å. In addition, these larger pores aid rapid through-particle diffusion, essential for efficient immobilization of combustion acids.

Pore volumes of the materials shown in FIG. 18 range from 0.8 to 1.4 ml/gm. However, the value for acceptable materials can vary considerably depending upon the material's particle size distribution and in particular, can be quite smaller than the low end of this range. This derives from the fact that in materials with broad size distributions, the smaller diameter particles occupy interstitial spaces formed by the larger particles and lead to a much reduced pore volume. If a binder is added, this additional material may occupy interstitial spaces and/or block available porosity and thus reduce overall pore volume. In contrast, low density strong base materials, such as those that occur in aerogels, xerogels, and cryogels, may have pore volumes that are considerably higher than this range. Thus, candidate materials may have a total intrusion volume that is greater than 0.3 ml/gm. Also with reference to FIG. 18, the preferred candidate materials have a median pore diameter of from about 55 Angstroms to about 350 Angstroms.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed:

1. A chemical filter for filtering oil within an internal combustion engine lubrication system to immobilize combustion acids, the chemical filter comprising:

filtration media including:

(a) a fibrous web;

(b) particles disposed within the fibrous web, said particles including internal pores formed within individual particles and interstitial pores formed between adjacent particles, the internal pores and the interstitial pores collectively defining filtration media pores; and (c) a strong base material associated with at least some of the internal pores and exposed to oil flowing through the chemical filter, wherein the strong base material associated with the filtration media pores has a surface area greater than or equal to 25 $m^2$/gm that is derived from filtration media pores having a median pore diameter between 60 Angstroms and 3,000 Angstroms as measured by mercury intrusion porosimetry and the strong base material is situated so as to interact with the oil within said engine lubrication system during use of said chemical filter such that said strong base material interacts with combustion acid-weak base complexes in said oil to immobilize said combustion acids and remove said combustion acids from the oil.

2. The chemical filter of claim 1, wherein adjacent particles that form the interstitial pores are bound to each other.

3. The chemical filter of claim 1, wherein the strong base material associated with the filtration media pores has a surface area greater than or equal to 30 $m^2$/gm that is derived from filtration media pores having a median pore diameter greater than or equal to 80 Angstroms as measured by mercury intrusion porosimetry.

4. The chemical filter of claim 1, wherein the strong base material associated with the filtration media pores has a surface area greater than or equal to 50 $m^2$/gm that is derived from filtration media pores having a median pore diameter greater than or equal to 80 Angstroms as measured by mercury intrusion porosimetry.

5. The chemical filter of claim 1, wherein the filtration media pores have a median pore diameter between 80 Angstroms and 3,000 Angstroms.

6. The chemical filter of claim 1, wherein a majority of the interstitial pores have a diameter that is less than 1 millimeter.

7. The chemical filter of claim 6, wherein a majority of the interstitial pores have a diameter that is less than 500 micrometers.

8. The chemical filter of claim 1, wherein the filtration media pores have a pore volume that is greater than 0.3 ml/gm.

9. The chemical filter of claim 1, wherein the strong base material includes magnesium oxide particles.

10. The chemical filter of claim 1, wherein the strong base material includes zinc oxide particles.

11. The chemical filter of claim 1, wherein the strong base material includes a blend of magnesium oxide and zinc oxide particles.

12. The chemical filter of claim 1, wherein the particles are made from a material selected from the group comprising activated carbon, carbon black, activated or transition alumina, silica gel, aluminosilicates, layered double hydroxides, micelle templated silicates and aluminosilicates, manganese oxide, mesoporous molecular sieves, MCM-type materials, diatomaceous earth or silicas, adsorbent resins, porous clays, montmorillonite, bentonite, magnesium silicate, zirconium oxide, Fuller's earth, cement binder, aerogels, xerogels, cryogels, metal-organic frameworks, isoreticular metal-organic frameworks, and mixtures thereof.

13. The chemical filter of claim 1, wherein the particles are made from a substrate material and the strong base material is disposed thereon.

14. The chemical filter of claim 13, wherein the substrate material is activated carbon.

15. The chemical filter of claim 1, wherein the particles are made from a substrate material and the strong base material is disposed on only some of the substrate material particles.

16. The chemical filter of claim 1, further comprising physically active filtration media.

17. The chemical filter of claim 1, wherein at least some of the particles are connected to each other with a binder material.

18. The chemical filter of claim 17, wherein the binder material includes a thermoplastic material selected from the group comprising polyolefins, polyvinyls, polyvinyl esters, polyvinyl ethers, polyvinyl sulfates, polyvinyl phosphates, polyvinyl amines, polyoxidiazoles, polytriazols, polycarbodiimides, polysulfones, polycarbonates, polyamides, polyethers, polyarylene oxides, polyesters, polyvinyl alcohol, polyacrylates, polyphoshazenes, polyurethanes and mixtures thereof.

19. The chemical filter of claim 17, wherein the binder material includes a material selected from the group comprising polyethylene, polypropylene, polybutene-1, poly-4-methylpentene-1, poly-p-phenylene-2,6-benzobisoxazole, poly-2,6-diimidazo pyridinylene-1,4 (2,5-dihydroxy) phenylene, polyvinyl chloride, polyvinyl fluoride, polyvinylidene chloride, polyvinyl acetate, polyvinyl proprionate, polyvinyl pyrrolidone, polysulfone, polycarbonate, polyethylene oxide, polymethylene oxide, polypropylene oxide, polyarylate, polyethylene terephthalate, polypara-phenylene-terephthalamide, polytetrafluoroethylene, ethylene-vinyl acetate copolymers, polyurethanes, polyimide, polybenzazole, para-Aramid fibers, and mixtures thereof.

20. The chemical filter of claim 17, wherein the binder material includes a material selected from the group comprising low density polyethylene, high density polyethylene, ethylene-vinyl acetate copolymer, and mixtures thereof.

21. The chemical filter of claim 17, wherein the binder material includes a nylon.

22. The chemical filter of claim 21, wherein the nylon is nylon 11.

23. The chemical filter of claim 17, wherein the binder material includes a thermoset material.

24. The chemical filter of claim 23, wherein the thermoset material includes a phenolformaldehyde resin and/or a melamine resin.

25. The chemical filter of claim 17, wherein the binder material includes a polymer colloid and/or a latex.

26. The chemical filter of claim 1, wherein the particles are immobilized within monolithic structures created by addition of a binder material to the particles.

27. The chemical filter of claim 26, wherein the binder includes an inorganic binder material.

28. The chemical filter of claim 27, wherein the inorganic binder material includes silica, alumina, aluminates, silicates, reactive oxides, aluminosilicates, metal powders, volcanic glass and/or clays.

29. The chemical filter of claim 27, wherein the inorganic binder material includes a kaolin clay, a meta-kaolin clay, attapulgus clay, and/or dolomite clay.

30. The chemical filter of claim 1, wherein the particles are immobilized within a monolithic structure created by addition of a polymeric organic binder and an inorganic binder.

31. The chemical filter of claim 1, wherein the fibrous web includes cellulosic fibers.

32. The chemical filter of claim 1, wherein the fibrous web includes synthetic fibers.

33. The chemical filter of claim 1, wherein the fibrous web is spirally wound to define multiple radially disposed layers.

34. The chemical filter of claim 1, wherein the chemical filter is employed within a full flow oil filter of an internal combustion engine lubrication system.

35. The chemical filter of claim 1, wherein the chemical filter is employed within one or more housings of an oil filter within an internal combustion engine lubrication system.

36. The chemical filter of claim 1, wherein the chemical filter is employed as part of a multi-stage oil filter of an internal combustion engine lubrication system.

37. The chemical filter of claim 1, wherein the chemical filter is employed within a by-pass portion of an oil filter of an internal combustion engine lubrication system.

38. An oil filter insert inserted into an oil filter casing for immobilizing combustion acids in oil flowing through the oil filter insert, the oil filter insert comprising:

a chemically active filtration member including filtration media including a fibrous web and particles disposed within the fibrous web, said particles having internal pores and interstitial pores formed between adjacent particles, and a strong base material associated with at least some of the internal pores and exposed to oil flowing through the oil filter insert, wherein filtration media pores are defined by the internal pores and interstitial pores formed between adjacent particles wherein the strong base material associated with the filtration media pores has a surface area greater than or equal to 25 $m^2$/gm that is derived from filtration media pores having a median pore diameter that is between 60 Angstroms and 3,000 Angstroms as measured by mercury intrusion porosimetry and the strong base material is situated so as to interact with the oil flowing through the oil filter insert during use such that said strong base material interacts with combustion acid-weak base complexes in said oil to immobilize said combustion acids and remove said combustion acids from the oil.

39. A chemical filter for filtering oil within an internal combustion engine lubrication system to immobilize combustion acids, the chemical filter comprising:

filtration media including:

(a) particles including internal pores formed within individual particles, said particles separated by interstitial pores formed between adjacent particles, wherein adjacent particles that form the interstitial pores are bound to each other, the internal pores and the interstitial pores collectively defining filtration media pores; and (b) a strong base material associated with at least some of the internal pores and exposed to oil flowing through the chemical filter, wherein the strong base material has a surface area greater or equal to 25 $m^2$/gm that is derived from filtration media pores having a pore diameter between 60 Angstroms and 3,000 Angstroms as measured by mercury intrusion porosimetry and the strong base material is situated so as to interact with the oil within said internal combustion engine lubrication system during use of said chemical filter such that said strong base material interacts with combustion acid-weak base complexes in said oil to immobilize said combustion acids and remove said combustion acids from the oil.

* * * * *